US007160849B2

(12) United States Patent
Tsumori et al.

(10) Patent No.: US 7,160,849 B2
(45) Date of Patent: Jan. 9, 2007

(54) SPECIFIC POLYMER-COMPOUNDED DETERGENT COMPOSITION

(75) Inventors: Takahiro Tsumori, Suita (JP); Takuya Saeki, Tokyo (JP); Yoshikazu Fujii, Suita (JP); Shigeru Yamaguchi, Suita (JP)

(73) Assignee: Nippon Shokubai Co., Ltd., Osaka (JP)

( * ) Notice: Subject to any disclaimer, the term of this patent is extended or adjusted under 35 U.S.C. 154(b) by 269 days.

(21) Appl. No.: 10/414,291

(22) Filed: Apr. 16, 2003

(65) Prior Publication Data

US 2003/0199420 A1 Oct. 23, 2003

(30) Foreign Application Priority Data

| | | | |
|---|---|---|---|
| Apr. 17, 2002 | (JP) | ..... | P. 2002-114307 |
| Apr. 18, 2002 | (JP) | ..... | P. 2002-116172 |
| Apr. 18, 2002 | (JP) | ..... | P. 2002-116181 |
| Aug. 6, 2002 | (JP) | ..... | P. 2002-228216 |

(51) Int. Cl.
*C11D 3/37* (2006.01)
*C11D 1/02* (2006.01)
*C11D 1/66* (2006.01)

(52) U.S. Cl. ..... 510/476; 510/351; 510/357; 510/361; 510/414; 510/426; 510/434; 510/477; 510/492; 510/495

(58) Field of Classification Search ..... 510/351, 510/357, 361, 414, 426, 434, 476, 477, 492, 510/495

See application file for complete search history.

(56) References Cited

U.S. PATENT DOCUMENTS

| | | | | |
|---|---|---|---|---|
| 4,471,100 | A | 9/1984 | Tsubakimoto et al. | |
| 4,500,693 | A | 2/1985 | Takehara et al. | |
| 5,952,432 | A | 9/1999 | Yamaguchi et al. | |
| 6,093,856 | A | 7/2000 | Cripe et al. | |
| 6,274,540 | B1 | 8/2001 | Scheibel et al. | |
| 6,310,156 | B1 | 10/2001 | Maeda et al. | |
| 2002/0028976 | A1 | 3/2002 | Connor | |
| 2002/0035224 | A1 | 3/2002 | Yamaguchi et al. | |
| 2003/0199420 | A1* | 10/2003 | Tsumori et al. | 510/475 |

FOREIGN PATENT DOCUMENTS

| | | | |
|---|---|---|---|
| EP | 0 754 712 | A1 | 1/1997 |
| EP | WO 97/39091 | * | 10/1997 |
| EP | 0 942 015 | A2 | 9/1999 |
| EP | 1 182 217 | A2 | 2/2002 |
| EP | 1 238 992 | A2 | 9/2002 |
| EP | 1 300 426 | A1 | 4/2003 |
| EP | 1354936 | * | 10/2003 |
| JP | 56-55407 | A | 5/1981 |
| JP | 56-81320 | A | 7/1981 |
| JP | 58-47099 | A | 3/1983 |
| JP | 58-147412 | A | 9/1983 |
| JP | 58-147413 | A | 9/1983 |
| JP | 58-149911 | A | 9/1983 |
| JP | 62-68806 | A | 3/1987 |
| JP | 62-86098 | A | 4/1987 |
| JP | 7-53645 | A | 2/1995 |
| JP | 8-208769 | A | 8/1996 |
| JP | 8-208770 | A | 8/1996 |
| JP | 11-507956 | A | 7/1999 |
| JP | 11-315115 | A | 11/1999 |
| JP | 2000-143737 | A | 5/2000 |
| JP | 2000-186298 | A | 7/2000 |
| JP | 2000-345198 | A | 12/2000 |
| JP | 2001-506679 | A | 5/2001 |
| JP | 2001-511473 | A | 8/2001 |
| JP | 2002-60433 | A | 2/2002 |
| JP | 2002-332391 | A | 11/2002 |
| JP | 2001-307757 | A | 10/2003 |
| WO | WO 97/39091 | | 10/1997 |
| WO | WO 98/23712 | A2 | 6/1998 |
| WO | WO 99/19444 | A1 | 4/1999 |

OTHER PUBLICATIONS

European Search Report dated Jun. 18, 2003.

* cited by examiner

*Primary Examiner*—Brian P Mruk
(74) *Attorney, Agent, or Firm*—Sughrue Mion, PLLC

(57) ABSTRACT

A detergent composition containing at least 0.1% by weight of at least one polymer selected from the group consisting of 1) a polycarboxylic acid-based polymer containing a polyalkylene glycol chain in the structure thereof, 2) a sulfonic acid group-terminated (meth)acrylic acid-based polymer, and 3) an acrylic acid (salt)-maleic acid (salt)-based copolymer having a clay dispersibility under a condition of 50 ppm of calcium carbonate of 0.3 or more; and at least 0.5% by weight of a longer alkyl chain mid-chain branched surfactant compound. The detergent composition can enhance anti-gelling properties to calcium ions, improve the dispersibility to solid particles at low temperatures or under high-hardness conditions, and improve detergency against stains such as mud and carbon black.

9 Claims, No Drawings

SPECIFIC POLYMER-COMPOUNDED DETERGENT COMPOSITION

FIELD OF THE INVENTION

The present invention relates to a detergent composition comprising a specific polymer and an alkyl mid-chain branched surfactant. For this reason, the detergent composition according to the invention is useful in laundry and cleaning compositions, especially granular and liquid detergent compositions. These detergent compositions have high detergency against stains such as mud and carbon black, enhance anti-gelling properties to calcium ions, etc., and enhance detergency at low temperatures or under high-hardness conditions.

DESCRIPTION OF THE RELATED ART

In the past, for the purpose of enhancing the detergency, there have been proposed various detergent compositions. In powder detergents, there are proposed detergent compositions having an improved solubility, as described in, for example, JP-A-2000-345198 and JP-A-2000-186298. However, these detergent compositions were not satisfactory in the solubility of detergent at low temperatures or detergency under high-hardness conditions. Further, JP-T-11-507956 and JP-T-2001-506679 (the term "JP-T" as used herein means a published Japanese translation of a PCT patent application") propose surfactant enhancing the solubility at low temperature and the detergency under high-hardness conditions as well as detergent compositions containing such a surfactant. However, according to the conventional polycarboxylic acid-based polymers that are used in these detergent compositions, a satisfactory performance was not obtained.

Similar to the powder detergents, in liquid detergents, according to detergent compositions using the foregoing surfactant, sufficient detergency could not be achieved because it is difficult to incorporate the polycarboxylic acid-based polymer.

JP-T-2001-511473 discloses alkoxylated polycarboxylates. However, the number of ethoxy side chains (m) is from 2 to 3, and sufficient dispersibility could not be achieved.

SUMMARY OF THE INVENTION

An object of the invention is to provide a detergent composition that can enhance anti-gelling properties to calcium ions, improve dispersibility to solid particles at low temperatures or under high-hardness conditions, and improve detergency against stains such as mud and carbon black.

In order to achieve the above object, the present inventors made extensive and intensive investigations about an enhancement of the detergency of the detergent composition. As a result, it has been found that when a specific polymer having good dispersibility of solid particles, good anti-gelling properties to calcium ions, etc., and good clay dispersibility and a mid-chain branched surfactant are formulated, the detergency against stains such as mud and carbon black are high and that the detergency are not lowered even at low temperatures or under high-hardness conditions, leading to accomplishment of the invention.

Specifically, the object of the invention is achieved the following detergent composition.

A detergent composition comprises:

at least 0.1% by weight of at least one polymer selected from the group consisting of 1) a polycarboxylic acid-based polymer containing a polyalkylene glycol chain in the structure thereof, 2) a sulfonic acid group-terminated (meth) acrylic acid-based polymer, and 3) an acrylic acid (salt)-maleic acid (salt)-based copolymer having a clay dispersibility under a condition of 50 ppm of calcium carbonate of 0.3 or more, and at least 0.5% by weight of a longer alkyl chain mid-chain branched surfactant compound represented by the following formula:

R—X—Y wherein:

(a) R is a hydrophobic C9 to C22, as total carbons in the moiety, preferably from C12 to C18, mid-chain branched alkyl moiety having: (1) a longest linear carbon chain attached to the —X—Y moiety in the range of from 8 to 21 carbon atoms; (2) one or more $C_1$–$C_3$ alkyl moieties branching from this longest linear carbon chain; (3) at least one of the branching alkyl moieties is attached directly to a carbon of the longest linear carbon chain at a position within the range of position 2 carbon (counting from carbon #1 which is attached to the —X—Y moiety) to position ω−2 carbon (the terminal carbon minus 2 carbons); and (4) the surfactant composition has an average total number of carbon atoms in the R—X moiety in the above formula within the range of greater than 14 to 18, preferably from 15 to 17;

(b) Y is a hydrophilic moiety selected from sulfates, sulfonates, amine oxides, and polyoxyalkylenes; and (c) X is selected from —$CH_2$— and —C(O)—.

DETAILED DESCRIPTION OF THE INVENTION

The embodiments for carrying out the invention will be described in detail below.

All percentages, ratios and proportions herein are by weight, unless otherwise specified. All temperatures are in degrees Celsius (° C.) unless otherwise specified. All documents cited are in relevant part, incorporated herein by reference.

Polycarboxylic Acid-based Polymers

Preferred examples of the polycarboxylic acid-based polymers containing a polyalkylene glycol chain in the structure thereof are as follows.

(1) Water-soluble graft polymers comprising a polyalkylene glycol having a monoethylenically unsaturated carboxylic acid-based monomer graft polymerized thereon:

Examples include water-soluble graft polymers in which a monoethylenically unsaturated monomer component essentially containing a monoethylenically unsaturated carboxylic acid-based monomer is graft polymerized on a polyether compound or a polyalkylene oxide substantially in the absence of a solvent, as described in JP-A-7-53645, JP-A-8-208769, JP-A-8-208770, and Japanese Patent Application No. 2002-061091.

The repeating number of the polyalkylene glycol is preferably from 3 to 100, more preferably from 4 to 50, and particularly preferably from 5 to 30.

These water-soluble graft polymers have better dispersibility of mud and carbon black and have good compatibility with liquid detergents, etc.

(2) Water-soluble polymers comprising a polyalkylene glycol-containing ethylenically unsaturated monomer (not containing an ester bond between the polyalkylene glycol chain and the ethylenically unsaturated bond) having a monoethylenically unsaturated carboxylic acid-based monomer copolymerized therewith:

Examples include copolymers of an unsaturated alcohol-based monomer and a monoethylenically unsaturated carboxylic acid-based monomer, as described in JP-A-56-81320, JP-A-58-47099, JP-A-58-149911, JP-A-58-147413, JP-A-58-147412, JP-A-62-68806, JP-A-62-86098, and Japanese Patent Application No. 2000-253003. Examples of the unsaturated alcohol-based monomer include compounds comprising a polyalkylene glycol monoallyl ether or an unsaturated alcohol (such as 3-methyl-3-buten-1-ol) having one or more alkylene oxides added thereto.

The repeating number of the polyalkylene glycol is preferably from 1 to 200, more preferably from 3 to 100, and particularly preferably from 5 to 50.

Since the chain backbone is not bound to the polyalkylene glycol via the ester bond, the stability of the polymer is good, and the dispersibility of mud and carbon black is better.

(3) Water-soluble polymers comprising a polyalkylene glycol-containing ethylenically unsaturated monomer (containing an ester bond between the polyalkylene glycol chain and the ethylenically unsaturated bond) having a monoethylenically unsaturated carboxylic acid-based monomer copolymerized therewith:

Examples include copolymers of a polyalkylene glycol ester of a monoethylenically unsaturated carboxylic acid-based monomer (such as polyalkylene glycol monoacrylates or monomethacrylates) and a monoethylenically unsaturated carboxylic acid-based monomer.

The repeating number of the polyalkylene glycol is preferably 5 or more, more preferably 10 or more, and particularly preferably 15 or more.

The molecular weight of the polycarboxylic acid-based polymer containing a polyalkylene glycol chain in the structure thereof is preferably from 1,000 to 200,000, more preferably from 2,000 to 100,000, and particularly preferably from 3,000 to 80,000.

The weight ratio of the polyalkylene glycol chain of the polycarboxylic acid-based polymer containing a polyalkylene glycol chain in the structure thereof to the carboxylic acid-based monomer is preferably from 1:99 to 99:1, more preferably from 5:95 to 95:5, and particularly preferably from 10:90 to 90:10.

(Meth)Acrylic Acid-based Polymers

Preferred examples of the sulfonic acid group-terminated (meth)acrylic acid-based polymer are as follows.

(1) Sulfonic acid group-terminated (meth)acrylic acid-based polymers comprising a (meth)acrylic acid-based polymer having an anti-gelling capacity Q of less than 2.0:

Examples include polymers comprising from 50 to 100 mole % of (meth)acrylic acid and from 0 to 50 mole % of a water-soluble monoethylenically unsaturated monomer that is copolymerizable with (meth)acrylic acid, having a sulfonic acid group at the terminals thereof and having an anti-gelling capacity Q, as defined by the following equation, of less than 2.0, as described in JP-A-11-315115.

$$Q=[(\text{Degree of gelation})\times 10^5]/(\text{Weight average molecular weight})$$

(2) (Meth)acrylic acid-based polymers having an introduction amount of sulfur element, S value of 35 or more:

Examples include (meth)acrylic acid-based polymers having an introduction amount of sulfur element, S value, as defined by the following equation, of 35 or more, as described in Japanese Patent Application No. 2001-307557.

$$S=(S\text{ amount contained in the polymer})/(\text{Total } S\text{ amount})\times 100$$

The total S amount includes the S amount contained in the polymer and the S amount of S-containing compounds derived from a residual initiator, etc.

Preferably, the anti-gelling capacity Q, as defined by the following equation, is less than 3.0.

$$Q=[(\text{Degree of gelation})\times 10^5]/(\text{Weight average molecular weight})$$

Preferably, the iron ion concentration is from 0.01 ppm to 10 ppm.

(3) (Meth)acrylic acid-based polymers having an R value of from 1 to 15:

Examples include (meth)acrylic acid-based polymers having an R value, as defined by the following equation, of from 1 to 15 in the $^1$H-NMR spectrum, as described in Japanese Patent Application No. 2001-307757.

$$R=(\text{Integration ratio of signal at 2.3 to 4.3 ppm})/(\text{Integration ratio at 0.8 to 4.3 ppm containing PSA signal})\times 100$$

Preferably, the anti-gelling capacity Q, as defined by the following equation, is less than 3.0.

$$Q=[(\text{Degree of gelation})\times 10^5]/(\text{Weight average molecular weight})$$

Preferably, the iron ion concentration is from 0.01 ppm to 10 ppm.

(4) Sulfonic acid group-terminated (meth)acrylic acid-based polymers produced by using a sulfite and oxygen:

Examples include sulfonic acid group-terminated (meth) acrylic acid-based polymers containing at least 0.1% by weight of a polymer obtained by polymerization using a sulfite and oxygen, as described in JP-A-56-55407.

As the sulfite, hydrogensulfites are preferable, and sodium hydrogensulfite is more preferable.

As the supply method of oxygen, oxygen may be supplied singly, but preferably, oxygen is supplied as air.

The polymerization may be carried out in a batch manner. In the case where the production amount is large, the polymerization may be carried out in a continuous manner.

The weight average molecular weight of the sulfonic acid group-terminated (meth)acrylic acid-base polymer is preferably in the range of from 1,000 to 20,000, more preferably from 2,000 to 15,000, and particularly preferably from 3,000 to 10,000.

Acrylic Acid (Salt)-maleic Acid (Salt)-based Copolymers

The acrylic acid (salt)-maleic acid (salt)-based copolymer used in the present invention has a clay dispersibility under a condition of 50 ppm of calcium carbonate of 0.3 or more, preferably 0.4 or more, more preferably 0.5 or more, and most preferably 0.6 or more.

The acrylic acid (salt)-maleic acid (salt)-based copolymer further has a clay dispersibility under a condition of 200 ppm of calcium carbonate of 0.2 or more, preferably 0.3 or more, more preferably 0.4 or more, and most preferably 0.5 or more.

The acrylic acid (salt)-maleic acid (salt)-based copolymer used in the present invention also has a calcium ion-binding capacity of 250 mg/g or more, preferably 260 mg/g or more, more preferably 270 mg/g or more, and most preferably 280 mg/g or more.

Preferred examples of the acrylic acid (salt)-maleic acid (salt)-based copolymer having a clay dispersibility under a condition of 50 ppm of calcium carbonate of 0.3 or more are as follows.

The weight average molecular weight of the copolymer is from 2,500 to 30,000, preferably from 3,000 to 20,000, more preferably from 3,500 to 15,000, particularly preferably from 4,000 to 13,000, and most preferably from 4,500 to 12,000.

The composition (molar) ratio of acrylic acid to maleic acid of the copolymer is from 99:1 to 40:60, preferably from 90:10 to 45:55, more preferably from 85:15 to 60:40, particularly preferably from 80:20 to 65:35, and most preferably from 80:20 to 67:33.

In the combination of the weight average molecular weight and the composition ratio of acrylic acid to maleic acid of the copolymer, the weight average molecular weight is from 2,500 to 30,000, and the composition (molar) ratio is from 99:1 to 40:60; preferably, the weight average molecular weight is from 3,000 to 20,000, and the composition (molar) ratio is from 90:10 to 45:55; more preferably, the weight average molecular weight is from 3,500 to 15,000, and the composition (molar) ratio is from 85:15 to 60:40; particularly preferably, the weight average molecular weight is from 4,000 to 13,000, and the composition (molar) ratio is from 80:20 to 65:35; and most preferably, the weight average molecular weight is from 4,500 to 12,000, and the composition (molar) ratio is from 80:20 to 67:33.

Examples include acrylic acid (salt)-maleic acid (salt)-based copolymers having a magnesium ion-binding capacity of 210 mg $Mg(OH)_2$/g or more and a magnesium hydroxide scale-inhibition capacity of 30% or more, as described in JP-A-2000-143737. Preferably, the clay-dispersibility in the presence of magnesium ions is 60% or more; and more preferably, the molecular weight distribution is 3.5 or less, and the amount of low-molecular weight portions having a molecular weight of 1,000 or less is 9% by weight or less based on the total amount of the copolymer.

Incidentally, in the invention, the acrylic acid (salt)-maleic acid (salt)-based copolymer may be of a complete acid type, a partially neutralized salt, or a completely neutralized salt. Preferred examples of the alkaline component used for the neutralization include alkali metal hydroxides such as sodium hydroxide and potassium hydroxide, alkaline earth metal hydroxides such as calcium hydroxide and magnesium hydroxide, ammonia, and organic amines such as monoethanolamine, diethanolamine, triethanolamine, and triethylamine; more preferably alkali metal hydroxides; and particularly preferably sodium hydroxide. With respect to the neutralization method by the alkaline component, partial neutralization or complete neutralization may be carried out after completion of the polymerization; partial neutralization or complete neutralization may be carried out during the polymerization; or previously partially neutralized and/or completely neutralized monomers may be polymerized.

The polymerization may be carried out in a batch manner. In the case where the production amount is large, the polymerization may be carried out in a continuous manner.

Any of the polycarboxylic acid-based polymer containing a polyalkylene glycol chain in the structure thereof, the sulfonic acid group-terminated (meth)acrylic acid-based polymer, and the acrylic acid (salt)-maleic acid (salt)-based copolymer having a clay dispersibility under a condition of 50 ppm of calcium carbonate of 0.3 or more is usually contained in an amount of 0.1% by weight or more, preferably 0.5% by weight or more, more preferably 1.0% by weight, and most preferably 3.0% by weight or more in the detergent composition.

Mid-chain Branched Surfactant

In the formula, R—X—Y, (a) R is a hydrophobic C9 to C22, as total carbons in the moiety, preferably from C12 to C18, mid-chain branched alkyl moiety having: (1) a longest linear carbon chain attached to the —X—Y moiety in the range of from 8 to 21 carbon atoms; (2) one or more $C_1$–$C_3$ alkyl moieties branching from this longest linear carbon chain; (3) at least one of the branching alkyl moieties is attached directly to a carbon of the longest linear carbon chain at a position within the range of position 2 carbon (counting from carbon 1 which is attached to the —X—Y moiety) to position ω−2 carbon (the terminal carbon minus 2 carbons); and (4) the surfactant composition has an average total number of carbon atoms in the R—X moiety in the above formula within the range of greater than 14 to 18, preferably from 15 to 17;

(b) Y is a hydrophilic moiety selected from sulfates, sulfonates, amine oxides, polyoxyalkylenes (preferably polyoxyethylene and polyoxypropylene), alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkalnolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betains, alkylated quats, alkylated/polyhydroxyalkylated quats, imidazolines, 2-yl-succinates, sulfonated alkyl esters, and sulfonated fatty acids; and (c) X is selected from —$CH_2$— and —C(O)—.

Preferred examples of the mid-chain branched surfactant are as follows.

(1) Mid-chain Branched Primary Alkyl Sulfate Surfactants:

The detergent composition of the invention may contain one or two or more mid-chain branched primary alkyl sulfate surfactants.

The surfactant mixture of the invention contains a surfactant having a linear primary alkyl sulfate chain backbone (i.e., the longest alkyl chain containing the sulfated carbon atom). These alkyl chain backbones have from 12 to 19 carbon atoms. Further, the molecule contains a branched primary alkyl moiety having at least 14, but not more than 20, carbon atoms. In addition, the surfactant mixture has an average total number of carbon atoms for the branched primary alkyl moiety within the range of from greater than 14 to about 18. Thus, the mixture of the invention contains at least one branched primary alkyl sulfate surfactant compound having a longest alkyl chain having from 12 or more carbon atoms or 19 or less carbon atoms, and the total number of carbon atoms including branching must be at least 14, and further, the average total number of carbon atoms for the branched primary alkyl chain is within the range of from greater than 14 to about 18.

The composition of the invention may contain a small amount of a linear, non-branched primary alkyl sulfate. Further, this linear, non-branched primary alkyl sulfate surfactant may be present as the result of the process used to manufacture the surfactant mixture having the requisite one or more mid-chain branched primary alkyl sulfates according to the invention, or for the purpose of formulating the detergent composition, a small amount of the linear, non-branched primary alkyl sulfate may be admixed into the final product formulation.

Further, the composition of the invention may contain a small amount of a non-sulfated mid-chain branched alcohol. Such a material may be present as the result of incomplete sulfation of the alcohol as used to prepare the alkyl sulfate surfactant, or these alcohols may be separately added to the detergent composition of the invention along with the mid-chain branched primary alkyl sulfate surfactant according to the invention.

The counter ion of the sulfate is hydrogen or a salt forming cation depending upon the method of synthesis. Examples of the salt forming cation include lithium, sodium, potassium, calcium, magnesium, quaternary alkylamines, and mixtures thereof. Preferred cations are ammonium, sodium, potassium, mono-, di- and trialkanol ammoniums, and mixtures thereof. Preferred alkanol ammonium salts of the invention are mono-, di- and tri-quaternary ammonium compounds having an ethanolamine, diethanolamine, or triethanolamine structure.

Preferred counter ions of the sulfate are sodium, potassium, and the C2 alkanol ammonium salts listed above, with sodium being most preferred.

The preferred surfactant mixture of the invention has one or more branched primary alkyl sulfates in an amount of at least 0.01% by weight, more preferably at least 5% by weight, and most preferably at least 20% by weight of the mixture. The total number of carbon atoms, including branching, is from 15 to 18. Further, in the case of this surfactant mixture, the average total number of carbon atoms in the branched primary alkyl moiety is within the range of from greater than 14 to about 18.

Preferred mono-methyl branched primary alkyl sulfates are selected from the group consisting of 3-methyl pentadecanol sulfate, 4-methyl pentadecanol sulfate, 5-methyl pentadecanol sulfate, 6-methyl pentadecanol sulfate, 7-methyl pentadecanol sulfate, 8-methyl pentadecanol sulfate, 9-methyl pentadecanol sulfate, 10-methyl pentadecanol sulfate, 11-methyl pentadecanol sulfate, 12-methyl pentadecanol sulfate, 13-methyl pentadecanol sulfate, 3-methyl hexadecanol sulfate, 4-methyl hexadecanol sulfate, 5-methyl hexadecanol sulfate, 6-methyl hexadecanol sulfate, 7-methyl hexadecanol sulfate, 8-methyl hexadecanol sulfate, 9-methyl hexadecanol sulfate, 10-methyl hexadecanol sulfate, 11-methyl hexadecanol sulfate, 12-methyl hexadecanol sulfate, 13-methyl hexadecanol sulfate, 14-methyl hexadecanol sulfate, and mixtures thereof.

Preferred di-methyl branched primary alkyl sulfates are selected from the group consisting of 2,3-methyl tetradecanol sulfate, 2,4-methyl tetradecanol sulfate, 2,5-methyl tetradecanol sulfate, 2,6-methyl tetradecanol sulfate, 2,7-methyl tetradecanol sulfate, 2,8-methyl tetradecanol sulfate, 2,9-methyl tetradecanol sulfate, 2,10-methyl tetradecanol sulfate, 2,11-methyl tetradecanol sulfate, 2,12-methyl tetradecanol sulfate, 2,3-methyl pentadecanol sulfate, 2,4-methyl pentadecanol sulfate, 2,5-methyl pentadecanol sulfate, 2,6-methyl pentadecanol sulfate, 2,7-methyl pentadecanol sulfate, 2,8-methyl pentadecanol sulfate, 2,9-methyl pentadecanol sulfate, 2,10-methyl pentadecanol sulfate, 2,11-methyl pentadecanol sulfate, 2,12-methyl pentadecanol sulfate, 2,13-methyl pentadecanol sulfate, and mixtures thereof.

The following branched primary alkyl sulfates having 16 carbon atoms and having one branching unit are examples of preferred branched surfactants useful in the composition of the invention.

Examples include 5-methylpentadecyl sulfate, 6-methylpentadecyl sulfate, 7-methylpentadecyl sulfate, 8-methylpentadecyl sulfate, 9-methylpentadecyl sulfate, and 10-methylpentadecyl sulfate, wherein the counter ion is preferably sodium.

The following branched primary alkyl sulfates having 17 carbon atoms and having two branching units are examples of preferred branched surfactants according to the invention.

Examples include 2,5-dimethylpentadecyl sulfate, 2,6-dimethylpentadecyl sulfate, 2,7-dimethylpentadecyl sulfate, 2,8-dimethylpentadecyl sulfate, 2,9-dimethylpentadecyl sulfate, and 2,10-dimethylpentadecyl sulfate, wherein the counter ion is preferably sodium.

(2) Mid-chain Branched Primary Alkyl Polyoxyalkylene Surfactants:

The branched surfactant composition of the invention may contain one or two or more mid-chain branched primary alkyl polyoxyalkylene surfactants.

The surfactant mixture of the invention contains a linear primary polyoxyalkylene chain backbone. These alkyl chain backbones have from 12 to 19 carbon atoms. Further, the molecule contains a branched primary alkyl moiety having at least 14, but not more than 20, carbon atoms. In addition, the surfactant mixture has an average total number of carbon atoms for the branched primary alkyl moiety within the range of from greater than 14 to about 18. Thus, the mixture of the invention contains at least one branched primary polyoxyalkylene surfactant compound having a longest alkyl chain having from 12 or carbon atoms or 19 or less carbon atoms, and the total number of carbon atoms including branching must be at least 14, and further the average total number of carbon atoms for the branched primary alkyl chain is within the range of from greater than 14 to about 18.

For example, a C16 total carbon (in the alkyl chain) primary polyoxyalkylene surfactant having 15 carbon atoms in the backbone must have a methyl branching unit, whereby the total number of carbon atoms in the molecule is 16.

The composition of the invention may contain a small amount of a linear, non-branched primary polyoxyalkylene. Further, this linear, non-branched primary polyoxyalkylene surfactant may be present as the result of the process used to manufacture the surfactant mixture having the requisite one or more mid-chain branched primary polyoxyalkylenes according to the invention, or for the purpose of formulating the detergent composition, a small amount of the linear, non-branched primary polyoxyalkylene may be admixed into the final product formulation.

Further, the composition of the invention may contain a small amount of a non-alkoxylated mid-chain branched alcohol. Such a material may be present as the result of incomplete alkoxylation of the alcohol as used to prepare the polyoxyalkylene surfactant, or these alcohols may be separately added to the detergent composition of the invention along with the mid-chain branched primary polyoxyalkylene surfactant according to the invention.

The polyoxyalkylene (EO/PO) is an alkoxy moiety, selected from ethoxy, propoxy, and mixed ethoxy/propoxy groups, and most preferably ethoxy, wherein the repeating number (m) of the oxyalkylene is at least about 1, preferably within the range of from about 3 to about 30, more preferably from about 5 to about 20, and most preferably from about 5 to about 15. The EO/PO may be a distribution with an average degree of alkoxylation (e.g., ethoxylation and/or propoxylation) corresponding to m, or a single specific chain with alkoxylation (e.g., ethoxylation and/or propoxylation) of exactly the number of units corresponding to m.

The preferred surfactant mixture of the invention has one or more mid-chain branched primary alkyl polyxoyalkylenes in an amount of at least 0.01% by weight, more preferably at least 5% by weight, and most preferably at least 20% by weight of the mixture. The total number of carbon atoms, including branching, is from 15 to 18. Further, in the case of this surfactant mixture, the average total number of carbon atoms in the branched primary alkyl moiety is within the range of from greater than 14 to about 18. Here, EO/PO is an alkoxy moiety, selected from ethoxy, propoxy, and mixed ethoxy/propoxy groups, and most preferably ethoxy, wherein m is at least about 1, preferably within the range of from about 3 to about 30, more preferably from about 5 to about 20, and most preferably from about 5 to about 15. More preferred are compositions having at least 5% by weight of the mixture comprising one or more mid-chain branched primary polyoxyalkylenes.

Preferably, the surfactant mixture contains at least 5% by weight, and more preferably at least about 20% by weight of the mid-chain branched primary alkyl polyoxyalkylene.

The preferred detergent composition according to the invention contains from about 0.01 to about 99% by weight of a mixture of mid-chain branched primary alkyl polyoxyalkylene surfactants.

Further, in the case of this surfactant mixture, the average total number of carbon atoms in the branched primary alkyl moiety is within the range of from greater than 14 to about 18. Here, EO/PO is an alkoxy moiety, selected from ethoxy, propoxy, and mixed ethoxy/propoxy groups, and most preferably ethoxy, wherein m is at least about 1, preferably within the range of from about 3 to about 30, more preferably from 5 to about 20, and most preferably from about 5 to about 15. Moreover, the surfactant composition of the invention may be a mixture comprising one or more mid-chain branched primary alkyl polyoxyalkylenes. In the foregoing, the total number of carbon atoms, including branching, is from 14 to 20.

In addition, in the case of this surfactant mixture, the average total number of carbon atoms in the branched primary alkyl moieties is within the range of from greater than 14 to about 18. EO/PO is an alkoxy moiety, selected from ethoxy, propoxy, and mixed ethoxy/propoxy groups, wherein m is at least about 1, preferably within the range of from about, 3 to about 30, more preferably from 5 to about 20, and most preferably from about 5 to about 15.

Preferred mono-methyl branched primary alkyl ethoxylates are selected from the group consisting of 3-methyl pentadecanol ethoxylate, 4-methyl pentadecanol ethoxylate, 5-methyl pentadecanol ethoxylate, 6-methyl pentadecanol ethoxylate, 7-methyl pentadecanol ethoxylate, 8-methyl pentadecanol ethoxylate, 9-methyl pentadecanol ethoxylate, 10-methyl pentadecanol ethoxylate, 11-methyl pentadecanol ethoxylate, 12-methyl pentadecanol ethoxylate, 13-methyl pentadecanol ethoxylate, 3-methyl hexadecanol ethoxylate, 4-methyl hexadecanol ethoxylate, 5-methyl hexadecanol ethoxylate, 6-methyl hexadecanol ethoxylate, 7-methyl hexadecanol ethoxylate, 8-methyl hexadecanol ethoxylate, 9-methyl hexadecanol ethoxylate, 10-methyl hexadecanol ethoxylate, 11-methyl hexadecanol ethoxylate, 12-methyl hexadecanol ethoxylate, 13-methyl hexadecanol ethoxylate, 14-methyl hexadecanol ethoxylate, and mixtures thereof, wherein the compounds are ethoxylated with an average degree of ethoxylation of from about 5 to about 15.

Preferred di-methyl branched primary alkyl ethoxylates are selected from the group consisting of 2,3-methyl tetradecanol ethoxylate, 2,4-methyl tetradecanol ethoxylate, 2,5-methyl tetradecanol ethoxylate, 2,6-methyl tetradecanol ethoxylate, 2,7-methyl tetradecanol ethoxylate, 2,8-methyl tetradecanol ethoxylate, 2,9-methyl tetradecanol ethoxylate, 2,10-methyl tetradecanol ethoxylate, 2,11-methyl tetradecanol ethoxylate, 2,12-methyl tetradecanol ethoxylate, 2,3-methyl pentadecanol ethoxylate, 2,4-methyl pentadecanol ethoxylate, 2,5-methyl pentadecanol ethoxylate, 2,6-methyl pentadecanol ethoxylate, 2,7-methyl pentadecanol ethoxylate, 2,8-methyl pentadecanol ethoxylate, 2,9-methyl pentadecanol ethoxylate, 2,10-methyl pentadecanol ethoxylate, 2,11-methyl pentadecanol ethoxylate, 2,12-methyl pentadecanol ethoxylate, 2,13-methyl pentadecanol ethoxylate, and mixtures thereof, wherein the compounds are ethoxylated with an average degree of ethoxylation of from about 5 to about 15.

(3) Mid-chain Branched Primary Alkyl Alkoxylated Sulfate Surfactants:

The branched surfactant composition of the invention may contain one or more (preferably a mixture of two or more) mid-chain branched primary alkyl alkoxylated sulfates.

The surfactant mixture of the invention contains molecules having a linear primary alkoxylated sulfate chain backbone (i.e., the longest linear carbon chain including the alkoxy-sulafted carbon atom). These alkyl chain backbones have from 12 to 19 carbon atoms, and further, the molecules contain a branched primary alkyl moiety having at least a total of 14, but not more than 20, carbon atoms. In addition, the surfactant mixture has an average total number of carbon atoms for the branched primary alkyl moieties within the range of from greater than 14 to about 18. Thus, the mixture of the invention comprises at least one alkoxylated sulfate compound having a longest linear carbon chain of 12 or more carbon atoms or 19 or less carbon atoms, and the total number of carbon atoms including branching must be at least 14, and further, the average total number of carbon atoms for the branched primary alkyl chains is within the range of from greater than 14 to about 18.

For example, a C16 total carbon (in the alkyl chain) primary alkyl alkoxylated sulfate surfactant having 15 carbon atoms in the backbone must have a methyl branching unit, whereby the total number of carbon atoms in the primary alkyl moiety of the molecule is 16.

The composition of the invention may still further contain a small amount of a linear, non-branched primary alkoxylated sulfate. Further, this linear, non-branched primary alkoxylated sulfate surfactant may be present as the result of the process used to manufacture the surfactant mixture having the requisite mid-chain branched primary alkoxylated sulfates according to the invention, or for the purpose of formulating the detergent composition, a small amount of the linear, non-branched primary alkoxylated sulfate may be admixed into the final product formulation.

A small amount of a mid-chain branched alkyl sulfate may be present in the detergent composition. This is typically the result of sulfation of a non-alkoxylated alcohol remaining following incomplete alkoxylation of the mid-chain branched alcohol used to prepare the alkoxylated sulfate useful herein. However, such mid-chain branched alkyl sulfates may also be separately added.

In addition, the alkoxylated sulfate-containing composition of the invention may contain a small amount of a non-sulfated mid-chain branched alcohol (including polyoxyalkylene alcohols). Such materials may be present as the result of incomplete sulfation of the alcohol (alkoxylated or non-alkoxylated) used to prepare the alkoxylated surface surfactant, or these alcohols may be separately added to the detergent composition of the invention along with the mid-chain branched alkoxylated sulfate surfactant according to the invention.

The counter ion of the surfactant is described hereinbefore.

The polyoxyalkylene (EO/PO) is an alkoxy moiety, selected from ethoxy, propoxy, and mixed ethoxy/propoxy groups, wherein the repeating number (m) of the polyoxyalkylene is at least 0.01, preferably within the range of from 0.1 to 30, more preferably from 0.5 to 10, and most preferably from 1 to 5. The EO/PO may be a distribution with an average degree of alkoxylation (e.g., ethoxylation and/or propoxylation) corresponding to m, or a single specific chain with alkoxylation (e.g., ethoxylation and/or propoxylation) of exactly the number of units corresponding to m.

The preferred surfactant mixture of the invention has one or more mid-chain branched primary alkyl alkoxylated sulfate in an amount of at least 0.01% by weight, more preferably at least 5% by weight, and most preferably at least 20% by weight of the mixture.

The total number of carbon atoms, including branching, is from 15 to 18. Further, in the case of this surfactant mixture, the average total number of carbon atoms in the branched primary alkyl moiety is within the range of from greater than 14 to about 18. Here, EO/PO is an alkoxy moiety, selected from ethoxy, propoxy, and mixed ethoxy/propoxy groups, wherein m is at least 0.01, preferably within the range of from 0.1 to 30, more preferably from 0.5 to 10, and most preferably from 1 to 5. More preferred are compositions having at least 5% by weight of the mixture comprising one or more mid-chain branched primary alkoxylated sulfates.

The preferred detergent composition according to the invention contains from 0.01 to 99% by weight of a mixture of mid-chain branched primary alkyl alkoxylated sulfate surfactants, the mixture containing at least 5% by weight of one or more mid-chain branched alkyl alkoxylated sulfates. The counter ion of the surfactant is one or more cations.

Further, in the case of this surfactant mixture, the average total number of carbon atoms in the branched primary alkyl moieties is within the range of from greater than 14 to about 18. Here, EO/PO is an alkoxy moiety, selected from ethoxy, propoxy, and mixed ethoxy/propoxy groups, wherein m is at least 0.01, preferably within the range of from 0.1 to 30, more preferably from 0.5 to 10, and most preferably from 1 to 5.

Further, the surfactant composition of the invention may be a mixture of the foregoing branched primary alkyl alkoxylated sulfates. The total number of carbon atoms, including branching, is from 14 to 20. Moreover, in the case of this surfactant mixture, the average total number of carbon atoms in the branched primary alkyl moieties is within the range of greater than 14 to 18. Here, EO/PO is an alkoxy moiety, selected from ethoxy, propoxy, and mixed ethoxy/propoxy groups, wherein m is at least 0.01, preferably within the range of from 0.1 to 30, more preferably from 0.5 to 10, and most preferably from 1 to 5. Also preferred are surfactant compositions containing less than 50% by weight, preferably less than 40% by weight, more preferably less than 25% by weight, and most preferably less than 20% by weight of the branched primary alkyl alkoxylated sulfate.

Preferred mono-methyl branched primary alkyl ethoxylated sulfates are selected from the group consisting of 3-methyl pentadecanol ethoxylated sulfate, 4-methyl pentadecanol ethoxylated sulfate, 5-methyl pentadecanol ethoxylated sulfate, 6-methyl pentadecanol ethoxylated sulfate, 7-methyl pentadecanol ethoxylated sulfate, 8-methyl pentadecanol ethoxylated sulfate, 9-methyl pentadecanol ethoxylated sulfate, 10-methyl pentadecanol ethoxylated sulfate, 11-methyl pentadecanol ethoxylated sulfate, 12-methyl pentadecanol ethoxylated sulfate, 13-methyl pentadecanol ethoxylated sulfate, 3-methyl hexadecanol ethoxylated sulfate, 4-methyl hexadecanol ethoxylated sulfate, 5-methyl hexadecanol ethoxylated sulfate, 6-methyl hexadecanol ethoxylated sulfate, 7-methyl hexadecanol ethoxylated sulfate, 8-methyl hexadecanol ethoxylated sulfate, 9-methyl hexadecanol ethoxylated sulfate, 10-methyl hexadecanol ethoxylated sulfate, 11-methyl hexadecanol ethoxylated sulfate, 12-methyl hexadecanol ethoxylated sulfate, 13-methyl hexadecanol ethoxylated sulfate, 14-methyl hexadecanol ethoxylated sulfate, and mixtures thereof, wherein the compounds are ethoxylated with an average degree of ethoxylation of from 0.1 to 10.

Preferred di-methyl branched primary alkyl ethoxylated sulfates are selected from the group consisting of 2,3-methyl tetradecanol ethoxylated sulfate, 2,4-methyl tetradecanol ethoxylated sulfate, 2,5-methyl tetradecanol ethoxylated sulfate, 2,6-methyl tetradecanol ethoxylated sulfate, 2,7-methyl tetradecanol ethoxylated sulfate, 2,8-methyl tetradecanol ethoxylated sulfate, 2,9-methyl tetradecanol ethoxylated sulfate, 2,10-methyl tetradecanol ethoxylated sulfate, 2,11-methyl tetradecanol ethoxylated sulfate, 2,12-methyl tetradecanol ethoxylated sulfate, 2,3-methyl pentadecanol ethoxylated sulfate, 2,4-methyl pentadecanol ethoxylated sulfate, 2,5-methyl pentadecanol ethoxylated sulfate, 2,6-methyl pentadecanol ethoxylated sulfate, 2,7-methyl pentadecanol ethoxylated sulfate, 2,8-methyl pentadecanol ethoxylated sulfate, 2,9-methyl pentadecanol ethoxylated sulfate, 2,10-methyl pentadecanol ethoxylated sulfate, 2,11-methyl pentadecanol ethoxylated sulfate, 2,12-methyl pentadecanol ethoxylated sulfate, 2,13-methyl pentadecanol ethoxylated sulfate, and mixtures thereof, wherein the compounds are ethoxylated with an average degree of ethoxylation of from 0.1 to 10.

The detergent composition of the invention contains from 0.01 to 99.9% by weight of detergent auxiliary components. These detergent auxiliary components and preferred other detergent auxiliary components that are optionally used will be described below in detail.

The detergent composition of the invention include a wide range of daily detergent product compositions inclusive of kinds to be shipped, such as powders, liquids, granules, gels, pastes, tablets, small bags, bars, and double-partitioned containers, sprays or foamed detergents and other homogenous or multi-phase daily detergent product forms. These products can be manually used or coated, and/or can be used in a constant or freely variable amount of use, or by automatic charge means, or can be used in electric products such as washing machines. These products can have a wide range of pH of, e.g., from 2 to 12 or more, and several tens gram-equivalent, per 100 g of the formulation, of NaOH may be added. These products can have a wide range of preliminary alkalinity. Both types of high suds and low suds detergents are included.

Light-duty Liquid Detergents (LDL):

These compositions include LDL compositions containing magnesium ions for improving surface activity and/or organic diamines and/or various foam stabilizers and/or suds boosters, such as amine oxides and/or skin feeling improvers of surfactant and relaxing agents and/or enzyme types including protease, and/or sterilizers.

Heavy-duty Liquid Detergents (HDL):

These compositions include all of so-called "structured" or multi-phase and "non-structured" or isotropic liquid types, and generally include aqueous or non-aqueous bleaching agents, and/or enzymes, or do not include bleaching agents and/or enzymes.

Heavy-duty Granular Detergents (HDG):

These compositions include both of a so-called "compact" or coagulated, or non-spray dried type and a so-called "flocculated" or spray dried type. These compositions include both of a phosphate addition type and a phosphate non-addition type. Such detergents can include a type comprising a more general anionic surfactant as a substrate, or may be a so-called "highly nonionic surfactant" type comprising a generally nonionic surfactant held on an absorbent, for example, in or on the surface of a zeolites or other porous inorganic salt.

Softeners (STW):

These compositions include various types of granular or liquid products that are softened by laundry, and can generally organic (such as quaternary) or inorganic (such as clay) softeners.

Bar Soaps (BS & HW):

These compositions include laundry bars and include both of a type comprising a synthetic detergent and a soap as substrates and a type containing a softener. Such compositions include compositions manufactured by general soap manufacture techniques, such as pressure molding, or techniques that are no so general, such as casting and absorption of surfactant into a porous support. Other hand wash detergents are also included.

Fabric Softeners (FS):

These compositions include both of the conventional liquid and concentrated liquid types and kinds to be added by dryers or supported by a substrate. Other fabric softeners include those that are solid.

Special purpose cleaners (SPC) including the following products may be considered. That is, there are house-hold dry detergent modes, pre-treatment products of laundry bleaching agents, pre-treatment products for fabric protection, liquid higher fabric detergent types, especially high suds products, liquid bleaching agents including both of chlorine type and oxygen bleaching agent type, disinfectants, detergent aids, pre-treatment types including, for example, bleaching additives and "stain-stick" or special sudsing type cleaners, and anti-fading treatment by sunlight.

Cleaners containing a durable perfume become general more and more.

Laundry or Detergent Components

The detergent composition of the invention contains from 0.01 to 99% by weight of at least one member selected from the group consisting of (i) detergent enzymes, and preferably enzymes selected from protease, amylase, lipase, cellulase, peroxidase, and mixtures thereof, (ii) organic detergent builders, and preferably builders selected from polycarboxylate compounds, ether hydroxy polycarboxylates, substituted ammonium salts of polyacetic acid, and mixtures thereof, (iii) enzyme bleaching agents, and preferably bleaching agents selected from hydrogen peroxide, inorganic peroxo hydrates, organic peroxo hydrates, organic peracids containing hydrophilic or hydrophobic mono- or di-peracids, and mixtures thereof, (iv) bleach surfactant, and preferably bleach surfactant selected from TAED, NOBS, and mixtures thereof, (v) transition metal bleaching agent catalysts, and preferably manganese-containing bleaching agent catalysts, (vi) oxygen transfer agents and precursor materials, (vii) polymeric soil releasing agents, (viii) water-soluble ethoxylated amines having clay soil removal and anti-redeposition characteristics, (ix) polymeric dispersing agents, (x) polymeric dye transfer inhibitors, (xi) alkoxylated polycarboxylates, and (xii) mixtures thereof.

In general, the laundry or detergent auxiliary components are all components necessary for converting a composition containing only the minimum essential components into a composition useful for the laundry or detergent purpose.

In preferred embodiments, it can be easily recognized by those skilled in the art that the laundry or detergent auxiliary components are indispensable for laundry or detergent products, especially laundry or detergent products for direct use by consumers in the house-hold environment.

The precise nature of these additional components, and levels of incorporation thereof vary depending upon the physical form of the composition and the nature of the cleaning operation for which it is to be used.

Preferably, in the case where the auxiliary components are used along with the bleaching agent, they must have good stability to the bleaching agent. The specific preferred detergent composition of the invention should be of a boron-free or phosphoric acid-free pursuant to the regulations. The amount of the auxiliary components is from 0.01 to 99.9% by weight, and typically from 70 to 95% by weight of the composition. The amount of the whole of the composition to be used can be widely varied in the range of, for example, from several ppm in the solution to the case of the so-called "direct application" of the non-dilute detergent composition on the surface to be cleaned depending on the intended object.

Examples of the general auxiliary components include builders, surfactants, enzymes, polymers, bleaching agents, bleach surfactants, and catalyst components other than those as already defined above as the essential components in the composition of the invention. Examples of other auxiliary components include various active components or special components such as dispersant polymers, color speckles, silver protecting agents, anti-fogging agents and/or corrosion inhibitors, dyes, fillers, sterilizers, alkaline agents, hydrotropic agents, antioxidants, enzyme stabilizers, pro-perfumes, perfumes, plasticizers, carriers, processing aids, pigments, and solvents for liquid formulations.

Extremely typically, the laundry or washing compositions of the invention, for example, laundry detergents, laundry detergent additives, synthetic and soap-based laundry bars, fabric softeners, and fabric processing liquids, often require some kinds of auxiliary components. But, some simply formulated products such as bleaching additives, require only, for example, enzyme bleaching agents and surfactants as described herein.

Detergent Surfactants:

This composition may contain known detergent surfactants and is widely described in the known literature references.

Accordingly, the detergent surfactants of the invention contain anionic, nonionic, zwitter-ionic or amphiprotic (amphiphilic) surfactants that are known as detergents in fabric laundering.

In all of the detergent surfactants, the chain length of the hydrophobic moiety is typically in the general range of from C8 to C20, and especially in the case of laundering with cold water, the chain length is often preferably in the range of from C8 to C18.

Detergent Enzymes:

The detergent composition of the invention preferably uses enzymes for various purposes such as removal of protein-based, carbohydrate-based, or triglyceride-based soils from substrates, transfer inhibition of refugee dyes in fabric laundering, and fabric restoration.

The "detergent enzymes" as used herein mean all of enzymes having advantageous effects in washing, soil removal, and others in laundering.

Builder:

The composition of the invention controls the hardness of minerals in washing water, especially Ca and/or Mg, makes it easy to remove and/or disperse granular soils from the surface, and optionally imparts an alkaline agent and/or buffer action. In granular or powder detergents, the builder may function as an absorbent for the surfactant. Alternatively, some compositions can be formulated in a completely water-soluble form, which may be either organic or inorganic, depending on the intended utility.

Suitable silicate builders include water-soluble types and hydrated solid types, and include other kinds such as those having a chain, layer or steric structure, amorphous solid silicates, and those as prepared such that they are used as not particularly structured liquid detergents.

Aluminosilicate builders, so-called zeolites, are particularly useful in granular detergents, but can be incorporated into pastes or gels. The aluminosilicates may be crystalline or amorphous, or may be natural or synthetic.

For the purpose of making it easy to control the hardness of minerals in the washing water, especially Ca and/or Mg, or of making it easy to remove granular solids from the surface, the composition of the invention may optionally contain detergent builders in place of or in addition to the foregoing silicates and aluminosilicates. The builders can be made to function in various mechanisms so as to form soluble or insoluble complexes with mineral ions by ion exchange or by providing mineral ions with the surface more adherent than the surface of the material to be cleaned. The amount of the builder can be varied widely depending on the final utility and physical form of the composition.

Here, suitable builder can be selected from the group consisting of phosphates and polyphosphates, especially sodium salts, carbonates, bicarbonates, sodium carbonate, organic mono-, di-, tri-, and tetracarboxylates, especially water-soluble non-surfactant carboxylates in acid, sodium, potassium or alkanolammonium forms, and aliphatic and aromatic type-containing oligomers or water-soluble low-molecular polymer carboxylates. For example, for the purpose of pH buffer, these builders can be complemented by all of fillers or carriers that are important in the techniques of detergent compositions including borates or sulfates, especially sodium sulfate, and other stabilized surfactants and/or builders.

In the invention, builder mixtures can be used. In general, the builder mixture optionally comprises two or more usual builders, and is complemented by a chelating agent, a pH buffer, or a filler.

Examples of phosphorus-containing builders include polyphosphates, represented by tripolyphosphates, pyrophosphates, and glassy polymer metaphosphates, of alkali metals and ammonium and alkanolammoniums, and phosphonates.

Suitable carbonate builders include carbonates of an alkaline earth metal or an alkali metal, inclusive of carbonate minerals such as sodium bicarbonate and sodium carbonate, complex salts of sodium carbonate or potassium carbonate, and calcium carbonate.

As described herein, the "organic detergent builders" suitable for the use along with the alkylaryl sulfonate surfactant include polycarboxylate compounds including water-soluble non-surfactant dicarboxylates and tricarboxylates. More generally, the builder polycarboxylate has plural carboxylate groups, preferably at least three carboxylates. The carboxylate builder can be incorporated in an acidic or partially neutral, neutral or excessively basic form. In the case of the salt form, salts of alkali metals such as sodium, potassium, and lithium, or alkanolammonium salts are preferred. The polycarboxylate builder includes ether polycarboxylates.

Citric acid salts such as citric acid and soluble salts thereof are a polycarboxylate builder important for, for example, heavy-duty liquid detergents because they are available from resources that can be regenerated and are biodegradable. The citric acid salts can also be used in granular compositions especially in combination of zeolites and/or layered silicates. Oxydisuccinic acid salts are especially useful in such compositions and combinations.

Oxygen Bleaching Agents:

The preferred composition of the invention comprises an "oxygen bleaching agent" as a part or whole of the laundry or detergent auxiliary components. As useful oxygen bleaching agents of the invention, any known oxidizing agents can be used. Though oxygen bleaching agents or mixtures thereof are preferred, other oxidizing agent bleaching agents such as systems of generating hydrogen peroxide by oxygen or an enzyme, or hypohalogenic acid salts, for example, chlorine bleaching agents such as hyposulfites, can also be used.

Examples of peroxide-based general oxygen bleaching agents include hydrogen peroxide, inorganic peroxohydrates, organic peroxohydrates, and organic peroxy acids including hydrophilic or hydrophobic mono- or diperoxy acids. These components may be peroxycarboxylic acids, perpoxyimide acids, amidoperoxycarboxylic acids, or salts thereof including their calcium, magnesium or mixed cationic salts. Various kinds of peracids can be used in a liberated form or as precursor materials called "bleach surfactant" or "bleach promoters", which release peracids corresponding to hydrolysis in the case of a combination with a supply source of hydrogen peroxide.

Inorganic peroxides, suproxides, organic hydroperoxides such as cumene hydroperoxide and t-butyl hydroperoxide, and inorganic peroxo acids and salts thereof, such as peroxosulfates, are also useful as the oxygen bleaching agent.

Mixed oxygen bleaching agent systems are generally effective as in mixtures of oxygen bleaching agents with known bleach surfactant, organic catalysts, enzyme catalysts, or mixtures thereof. Further, these mixtures can further contain brighteners, light bleaching agents, and dye transfer inhibitors of types that are well known in this field.

As described above, the preferred oxygen bleaching agent includes hydroperoxides and peroxohydrates. These components are organic salts, or more generally, inorganic salts that can readily release hydrogen peroxide. The peroxohydrates are a general example of the "hydrogen peroxide source" and include perborates, percarbonates, perphosphates, and persilicates. Preferred peroxohydrates include all of sodium carbonate hydroperoxide and equivalent commercially available "percarbonate" bleaching agents, and so-called sodium perborate hydrtates, and sodium pyrrophosphate hydroperoxide can also be used. Urea hydroperoxides are also useful as the peroxohydrate.

There are included inorganic peroxohydrates, organic peroxohydrates, hydrophilic or hydrophobic mono- or diperacids, organic peracids including peroxycarboxylic acids, peroxyimide acids, and amidoperoxycarboxylic acids, salts of calcium, magnesium, or mixed cationic salts Bleach Surfactant:

Examples of useful bleach surfactant include amides, imides, esters, and acid anhydrides. Generally, there is present at least one substituted or unsubstituted acyl moiety having a leaving group in the structure, R—C(O)-L. As a preferred method of use, is a combination of the bleach surfactant with a hydrogen peroxide supply source such as perborates and percarbonates. One or more peracid-forming moieties or leaving groups can be present. Mixtures of bleach surfactants can be used.

The bleach surfactant can be used in an amount of up to 20% by weight, and preferably from 0.1 to 10% by weight of the composition. For the form of highly concentrated bleaching agent additive products or the form in which the bleach surfactant is used in an automatic charge device, it can be used in an amount of 40% by weight or more.

Transition Metal Bleaching Agent Catalysts:

Manganese compounds can be optionally used as the bleaching compound to have a catalytic action. As useful cobalt bleaching catalysts, ones that are known may be used.

Enzyme-based Supply Sources of Hydrogen Peroxide:

Besides the above-enumerated bleach surfactant, other suitable hydrogen peroxide generating mechanisms include combinations of C1 to C4 alkanol oxidases and C1 to C4 alkanols, especially a combination of methanol oxidase (MOX) and ethanol. Bleaching-related other enzymatic materials such as peroxidases, haloperoxidases, and oxidases, superoxide molecular displacement enzymes, catalases, and their reinforcing agents, or more generally, inhibitors can be optionally used in the composition.

Oxygen Transfer Agents and Precursors:

All of known organic bleaching agent catalysts, oxygen transfer agents, or precursors thereof are also useful herein. These materials include their compounds themselves and/or precursors thereof, such as all of ketones suitable for manufacture of dioxiranes, and and/or dixoirane precursors or all different atom-containing analogues of dioxiranes. As preferred examples of such components, are especially included hydrophilic or hydrophobic ketones that manufacture the dioxiranes on the spot, along with monoperoxysulfate. Examples of such oxygen bleaching agents that are preferably used along with the oxygen transfer agent or precursor include percarboxylic acids and salts, percarbonic acids and slats, peroxy monosulfuric acid and salts, and mixtures thereof.

Polymeric Soil Releasing Agents:

The composition of the invention can optionally comprise one or more soil releasing agents. The polymeric soil releasing agent is characterized by having hydrophilic segments to hydrophilize the surface of hydrophobic fibers such as polyester and nylon and hydrophobic segments to deposit upon hydrophobic fibers and remain adhered thereto through completion of the laundry cycle to function as an anchor for the hydrophilic segments. This can enable stains occurring sequent to treatment with the soil releasing agent to be more easily cleaned in later washing procedures.

In the case of the use, the soil releasing agent generally accounts for from about 0.01 to about 10% by weight of the composition.

Clay Soil Removal/Anti-redeposition Agents:

The composition of the invention can also optionally contain water-soluble ethoxylated amines having clay soil removal and anti-redeposition properties. Granular detergent compositions containing these compounds typically contain from about 0.01% to about 10.0% by weight of the water-soluble ethoxylated amines, and liquid detergent compositions typically contain about 0.01% to about 5% by weight of the water-soluble ethoxylated amines.

Preferred soil release and anti-redeposition agents are ethoxylated tetraethylenepentamine. Other preferred soil release removal/anti-redeposition agents are ethoxylated amine polymers, zwitter-ionic polymers, and amine oxides. Other soil release removal and/or anti-redeposition agents that are known in this field can also be used in the composition of the invention. Another type of the preferred anti-redeposition agent includes carboxy methyl cellulose (CMC)-based components.

Polymeric Dispersing Agents:

Polymeric dispersing agents can be effectively used in an amount of from about 0.01 to about 10% by weight of the composition of the invention especially in the presence of zeolite and/or layered silicate builders. Suitable polymeric dispersing agents include polymeric polycarboxylates and polyethylene glycols, although others known in the art can also be used. It is believed that polymeric dispersing agents enhance overall detergent builder performance, when used in combination with other builders (including lower molecular weight polycarboxylates) by crystal growth inhibition, particulate soil release, peptization, and anti-redeposition.

Polymeric polycarboxylate materials can be prepared by polymerizing or copolymerizing suitable unsaturated monomers, preferably in their acid forms. Unsaturated monomeric acids that can be polymerized to form suitable polymeric polycarobyxlates include acrylic acid, maleic acid (or maleic anhydride), fumaric acid, itaconic acid, aconitic acid, mesaconic acid, citraconic acid, and methylenemalonic acid.

Particularly suitable polymeric polycarboxylates can be derived from acrylic acid. Such acrylic acid-based polymers that are useful herein are the water-soluble salts of polymerized acrylic acid. The average molecular weight of such polymers in the acid form preferably ranges from about 1,000 to 20,000, more preferably from about 2,000 to 15,000, and most preferably from about 3,000 to 10,000. Water-soluble salts of such acrylic acid polymers can include, for example, the alkali metal, ammonium and substituted ammonium salts.

Acrylic acid/maleic acid-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 3,000 to 80,000, and most preferably from about 4,000 to 70,000. The ratio of acrylate to maleate segments in such copolymers generally ranges from about 9:1 to about 1:9, and more preferably from about 8:2 to 3:7. Water-soluble salts of such acrylic acid/maleic acid copolymers can include, for example, the alkali metal, ammonium and substituted ammonium salts.

Copolymers of acrylic acid and/or maleic acid and a polyalkylene glycol can also be used as a preferred component of the dispersing/anti-redeposition agent. The copolymers are preferably graft polymers of acrylic acid and/or maleic acid and a polyalkylene glycol, copolymers of acrylic acid and/or maleic acid and an alkylene oxide adduct of allyl alcohol or isoprenol, and copolymers of acrylic acid and/or maleic acid and a polyalkylene glycol acrylate or methacrylate, and more preferably graft polymers of acrylic acid and/or maleic acid and a polyalkylene glycol and copolymers of acrylic acid and/or maleic acid and an alkylene oxide adduct of allyl alcohol or isoprenol.

The average molecular weight of the copolymers preferably ranges from about 2,000 to 100,000, more preferably from about 3,000 to 80,000, and most preferably from about 4,000 to 70,000.

Another polymeric component that can be incorporated is polyethylene glycol (PEG). PEG can exhibit dispersing agent performance as well as act as a clay soil removal/anti-redeposition agent. Typical molecular weight ranges for these purposes range from about 500 to about 100,000, preferably from about 1,000 to about 50,000, and more preferably from about 1,500 to about 10,000.

Polyasparatate and polyglutamate dispersing agents may also be used, especially in conjunction with zeolites builders. Dispersing agents such as polyasparatate preferably have a (weight average) molecular weight of about 10,000.

Brighteners:

In the detergent composition of the invention (in the case where it is designed for fabric washing or processing), any optical brighteners or other brightening or whitening agents known in this field can be incorporated generally in an amount of from about 0.01 to about 1.2% by weight.

Polymeric Dye Transfer Inhibiting Agents:

The composition of the invention may also include one or more materials effective for inhibiting the transfer of dyes from one fabric to another during the cleaning process. Generally, such dye transfer inhibiting agents include polyvinylpyrrolidone polymers, polyamide N-oxide polymers, copolymers of N-vinylpyrrolidone and N-vinylimidazole, manganese phthalocyanine, peroxidases, and mixtures thereof. If used, these agents generally comprise from about 0.01 to about 10% by weight, preferably from about 0.01 to about 5% by weight, and more preferably from about 0.05 to about 2% by weight of the composition.

The optical brightener selected for use in the invention exhibits especially effective dye transfer inhibition performance benefits when used in combination with the polymeric dye transfer inhibiting agent. The combination of such selected polymeric materials with such selected optical brightener provides significantly better dye transfer inhibition in aqueous wash solutions than does either of these two detergent composition components when used alone.

Chelating Agents:

The detergent composition of the invention may also optionally contain one or more chelating agents, especially chelating agents for transition metal coming from others. The transition metals generally seen in washing solutions include water-soluble, colloidal or granular iron and/or manganese and may sometimes associate as oxides or hydroxides. Preferred chelating agents are chelating agents that effectively inhibit such transition metals, especially inhibit such transition metals or their compounds to adhere to fabrics, and/or inhibit non-preferred redox reaction occurred in the washing medium and/or on the interface of the fabric or hard surface. The general chelating agents can be selected from the group consisting of amino carboxylates, amino phosphates, polyfunctionally-substituted aromatic chelating agents, and mixtures thereof.

The composition of the invention may also contain water-soluble methyl glycine diacetic acid salts as a chelating agent that can effectively be used together with insoluble builders such as zeolites and layered silicates.

If utilized, the chelating agent generally accounts for from about 0.01 to about 15% by weight of the composition. More preferably, if utilized, the chelating agent accounts for from about 0.01 to about 3.0% by weight.

Suds Suppressors:

In the case where washing is required in intended utilities, especially washing by washing machines, compounds for reducing or suppressing the formation of suds can be incorporated into the composition of the invention. For other compositions, for example, compositions as designed for hand washing, high sudsing may be desired, and such components can be omitted. Suds suppression can be of particularly importance in the so-called "high concentration cleaning process" and in front-loading European-style washing machines (so-called drum type washing machines).

A very wide variety of materials may be used as suds suppressors. The composition of the invention generally comprises from 0% by weight to about 10% by weight of suds suppressors.

Fabric Softeners:

Various through-the-wash fabric softeners can optionally be used in an amount of from about 0.5 to about 10% by weight to provide fabric softener benefits concurrently with fabric cleaning. Clay softeners can be used in combination with amine and cationic softeners. Further, in the cleaning process of the invention, known fabric softeners including those of biodegradation type can be used in modes including the pre-treatment, main cleaning, post-laundry, and addition into washing machines and dryers.

Perfumes:

Perfumes and perfumery ingredients useful in the compositions and processes comprise a wide variety of natural and synthetic chemical ingredients, including, but not limited to, aldehydes, ketones, and esters. Also, included are various natural extracts and essences that can comprise complex mixtures of ingredients such as orange oil, lemon, oil, rose extract, lavender, musk, patchouli, balsamic essence, sandalwood oil, pine oil, and cedar. Finished perfumes typically comprise from about 0.01 to about 2% by weight of the detergent composition, and individual perfumery ingredients can comprise from about 0.0001 to about 90% by weight of a finished perfume composition.

Other Ingredients:

A wide variety of other ingredients useful in detergent compositions can be included in the composition, including other ingredients, carriers, hydrotropes, processing aids, dyes or pigments, solvents for liquid formulations, and soil fillers for bar compositions. If high sudsing is desired, suds boosters such as C10 to C16 alkanolamides can be incorporated into the composition, typically in an amount of from 1% by weight to 10% by weight. C10 to C14 monoethanl and diethanol amides illustrate a typical class of such suds boosters. Use of such suds boosters with high sudsing adjuvant surfactants such as the amine oxides, betaines and sultanines noted above is also advantageous. If desired, water-soluble magnesium and/or calcium salts can be added typically in an amount of from 0.1% by weight to 2% by weight, to provide additional suds.

Various detergent ingredients employed in the composition can optionally be further stabilized by absorbing the ingredients onto a porous hydrophobic substrate, then coating the substrate with a hydrophobic coating. Preferably, the detergent ingredient is admixed with a surfactant before being absorbed into the porous substrate. In use, the detergent ingredient is released from the substrate into the aqueous washing liquor, where it performs its intended detergent function.

The liquid detergent composition can contain water and other solvents as diluents. Low-molecular weight primary or secondary alcohols exemplified by methanol, ethanol, propanol, and isopropanol are suitable. Monohydric alcohols are preferred for stabilizing the surfactant, but polyols such as those having from 2 to about 6 carbon atoms and from 2 to about 6 hydroxyl groups (such as 1,3-propanediol, ethylene glycol, glycerin, and propylene glycol) can also be used. The composition can contain such diluents in an amount of from 5% by weight to 90% by weight, and preferably from 10% by weight to 50% by weight.

The detergent composition is preferably formulated such that, during use in aqueous cleaning operations, the wash water has a pH of from about 6.5 to about 11, preferably from 7.5 to 10.5, and more preferably from about 7.0 to about 9.5. Laundry products are typically at a pH of from 9 to 11. Techniques for controlling the pH at recommended usage levels include the use of buffers, alkalis, acids, etc.

Forms of the Composition:

The composition of the invention can take a variety of physical forms including granular, gel, tablet, bar and liquid forms. These compositions include a so-called concentrated granular detergent composition adapted to be added to a washing machine by means of a dispensing device placed in the machine drum with the soiled fabric load.

Some preferred granular detergent compositions of the invention are of a general high-density type in the current commercial market.

Surfactant Agglomerate Particles:

One of preferred methods for incorporating the surfactants into daily products is the manufacture of surfactant agglomerate particles. These particles can take the form of flakes, prills, marumes, noodles, or ribbons, but preferably take the form of granules. A preferred way to process the particles is by agglomerating powders (such as aluminosilicates and carbonates) with highly active surfactant pastes to control the particle size of the resulting agglomerates within specified limits.

In the following Examples, all amounts are quoted as % by weight of the composition. The following Examples are illustrative of the invention, but are not meant to limit or otherwise define its scope. All parts, percentages and ratios used herein are expressed as percent weight unless otherwise specified.

In the following Examples, the abbreviations for various ingredients used for the compositions have the following meanings.

MLAS: Mid-chain branched sodium alkylbenzene sulfonate

LAS: Sodium linear alkylbenzene sulfonate

MBAS: Mid-chain branched primary alkyl (average total carbons=x) sulfate

MEA: Monoethanolamine

PG: Propylene glycol

EtOH: Ethanol

Carbonate: Anhydrous sodium carbonate with a particle size of from 200 to 900 μm Citrate: Trisodium citrate dihydrate with an activity of 86.4% and a particle size distribution of from 425 to 850 μm PSA: Sodium polyacrylate not terminated with a sulfonic acid group (weight average molecular weight=4,500), Q value: 3.92, S value: 0, R value: 0.0, iron ion concentration: 0.40 ppm AA/MA: Copolymer of acrylic acid/maleic acid (weight average molecular weight=70,000), acrylic acid/maleic acid composition ratio=80/20 (by mole), clay-dispersibility: 0.1 or less (at both for 50 ppm and 200 ppm of calcium carbonate), calcium ion-binding capacity: 410 mg/g PEG: Polyethylene glycol (weight average molecular weight=4,600)

Zeolite A: Hydrated sodium aluminosilicate of formula $Na_{12}(AlO_2SiO_2)_{12}.27H_2O$ Sulfate: Anhydrous sodium sulfate PB1: Sodium perborate monohydrate NOBS: Nonanoyloxybenzene sulfonate in the form of the sodium salt BPP: Butoxypropoxy propanol SFT: Softanol 70H, manufactured by Nippon Shokubai Co., Ltd., polyoxyethylene alkyl ether SMA: Stearyl trimethylammonium chloride In the case where no specific description is given, the ingredients are in the anhydrous form.

SYNTHESIS EXAMPLE 1

Water-soluble Graft Polymer (1) Comprising a Polyalkylene Glycol Having a Monoethylenically Unsaturated Carboxylic Acid-based Monomer Graft Polymerized Thereon:

In a 300-ml separable flask equipped with a stirrer, a condenser, a thermometer, a nitrogen-introducing tube and a dropping funnel, were charged 200 g of a polyethylene glycol comprising methanol having 10 moles of ethylene oxide added thereto (hereinafter referred to as "PGM-10"), 29.6 g of maleic anhydride, and 1.1 g of pure water, and about one hour after purging with nitrogen, the mixture was elevated to 120° C. while stirring. At the time when the temperature reached 120° C., 50.7 g of an acrylic acid solution of 100% by weight and 5.1 g of t-butyl peroxybenzoate (hereinafter referred to as "PBZ") were respectively added dropwise thereto over 150 minutes. After completion of the dropwise addition of the solutions, the mixture was aged at the same temperature (120±3° C.) for 2 hours to complete the polymerization. The resulting polymer had a weight average molecular weight of 8,300.

SYNTHESIS EXAMPLE 2

Water-soluble Graft Polymer (2) Comprising a Polyalkylene Glycol Having a Monoethylenically Unsaturated Carboxylic Acid-based Monomer Graft Polymerized Thereon:

In a 300-ml separable flask equipped with a stirrer, a condenser, a thermometer, a nitrogen-introducing tube and a dropping funnel, were charged 64 g of SOFT-70 (an ethylene oxide adduct of an alkyl alcohol, manufactured by Nippon Shokubai Co., Ltd.) and 64 g of PM-10, and about one hour after purging with nitrogen, the mixture was elevated to 130° C. while stirring. At the time when the temperature reached 130° C., 54.9 g and 4.4 g of an acrylic acid solution of 100% by weight were added dropwise thereto over 180 minutes and 120 minutes, respectively. After completion of the dropwise addition of the solution, the mixture was aged at the same temperature (130±3° C.) for 90 minutes to complete the polymerization. The resulting polymer had a weight average molecular weight of 11,000.

SYNTHESIS EXAMPLE 3

Water-soluble Polymer (1) Comprising a Polyalkylene Glycol-containing Ethylenically Unsaturated Monomer (Not Containing an Ester Bond Between the Polyalkylene Glycol Chain and the Ethylenically Unsaturated Bond) Having a Monoethylenically Unsaturated Carboxylic Acid-based Monomer Copolymerized Therewith:

In a 300-ml separable flask equipped with a stirrer, a condenser, a thermometer, a nitrogen-introducing tube and a dropping funnel, was charged 120 g of pure water, and after purging with nitrogen, the water was elevated to the reflux temperature while stirring. At the time when the temperature reached a prescribed temperature, 23.4 g of a sodium persulfate aqueous solution of 3% by weight, 60 g of an aqueous solution of 50% by weight of an unsaturated alcohol comprising 3-methyl-2-buten-1-ol having 10 moles of ethylene oxide added thereto (hereinafter referred to as "IPN-10"), and an aqueous solution of a mixture of 6.1 g of an acrylic acid aqueous solution of 80% by weight and 39.9 g of a sodium acrylate aqueous solution of 37% by weight were added dropwise thereto, respectively. However, IPN-10 and the acrylic acid monomer were added dropwise over 120 minutes, and the sodium persulfate aqueous solution was added dropwise over 150 minutes. After completion of the dropwise addition of the sodium persulfate aqueous solution, the mixture was aged at the same temperature for 30 minutes to complete the polymerization. The resulting polymer had a weight average molecular weight of 5,000.

SYNTHESIS EXAMPLE 4

Water-soluble Polymer (2) Comprising a Polyalkylene Glycol-Containing Ethylenically Unsaturated Monomer (not Containing an Ester Bond Between the Polyalkylene Glycol Chain and the Ethylenically Unsaturated Bond) Having a Monoethylenically Unsaturated Carboxylic Acid-based Monomer Copolymerized Therewith:

In a 300-ml separable flask equipped with a stirrer, a condenser, a thermometer, a nitrogen-introducing tube and a dropping funnel, were charged 16.35 g of maleic anhydride, 45.2 g of pure water, and 0.007 g of Mohr's salt, and after purging with nitrogen, the mixture was elevated to the reflux temperature (about 103° C.) while stirring. At the time when the temperature reached a prescribed temperature, a solution of 50 g of IPN-10 in 20 g of pure water, 43.0 g of an acrylic acid aqueous solution of 80% by weight, and a solution of 14.4 g of hydrogen peroxide of 35% by weight in 22 g of pure water were respectively added dropwise thereto over 120 minutes. After completion of the addition of the solutions, the mixture was aged at the reflux temperature for one hour to complete the polymerization. The resulting polymer had a weight average molecular weight of 12,000.

SYNTHESIS EXAMPLE 5

Water-soluble Polymer (3) Comprising a Polyalkylene Glycol-containing Ethylenically Unsaturated Monomer (not Containing an Ester Bond Between the Polyalkylene Glycol Chain and the Ethylenically Unsaturated Bond) Having a Monoethylenically Unsaturated Carboxylic Acid-based Monomer Copolymerized Therewith:

In a 300-ml separable flask equipped with a stirrer, a condenser, a thermometer, a nitrogen-introducing tube and a dropping funnel, were charged 20.42 g of maleic anhydride, 40 g of pure water, and 0.007 g of Mohr's salt, and after purging with nitrogen, the mixture was elevated to the reflux temperature (about 103° C.) while stirring. At the time when the temperature reached a prescribed temperature, a solution of 70 g of allyl alcohol having 5 moles of ethylene oxide added thereto (hereinafter referred to as "PEA-5") in 28 g of pure water, 28.1 g of an acrylic acid aqueous solution of 80% by weight, and a solution of 15 g of hydrogen peroxide of 35% by weight in 18 g of pure water were respectively added dropwise thereto over 120 minutes. After completion of the addition of the solutions, the mixture was aged at the reflux temperature for one hour to complete the polymerization. The resulting polymer had a weight average molecular weight of 14,000.

SYNTHESIS EXAMPLE 6

Water-soluble Polymer (4) Comprising a Polyalkylene Glycol-containing Ethylenically Unsaturated Monomer (Containing an Ester Bond Between the Polyalkylene Glycol Chain and the Ethylenically Unsaturated Bond) Having a Monoethylenically Unsaturated Carboxylic Acid-based Monomer Copolymerized Therewith:

In a 500-ml separable flask equipped with a stirrer, a condenser, a thermometer, a nitrogen-introducing tube and a dropping funnel, was charged 150 g of pure water, and after purging with nitrogen, the aqueous solution was elevated to 70° C. while stirring. At the time when the temperature reached a prescribed temperature, a solution of 22.95 g of an aqueous solution of sodium persulfate of 20% by weight, 80 g of an esterfication production of methacrylic acid and PGM-10, 60 g of a methacrylic acid solution of 100% by weight, and 55.23 g of an NaOH aqueous solution of 48% by weight were respectively added dropwise thereto over 120 minutes. After completion of the addition of the solutions, the mixture was aged at the same temperature for 60 minutes to complete the polymerization. The resulting polymer had a weight average molecular weight of 12,000.

Performance Evaluation:

Detergent formulations and formation amounts of polymer are as follows.

TABLE 1

(Formulation Example 1: Powder detergent model composed mainly of anions)

| Formulation | A | B | C |
|---|---|---|---|
| MLAS | 29 | 29 | 29 |
| SFT | 3 | 3 | 3 |
| SMA | 3 | 3 | 3 |
| Zeolite A | 30 | 30 | 30 |
| PEG | 1 | 1 | 1 |
| Carbonate | 29 | 29 | 29 |
| Water-soluble graft polymer (1) | 5 | | |
| Water-soluble polymer (2) | | 5 | |
| Water-soluble polymer (4) | | | 5 |

TABLE 2

(Formulation Example 2: Liquid detergent model composed mainly of nonions)

| Formulation | D | E | F |
|---|---|---|---|
| MBAS | 4 | 4 | 4 |
| SFT | 32 | 32 | 32 |

TABLE 2-continued (Formulation Example 2: Liquid detergent model composed mainly of nonions)

| Formulation | D | E | F |
|---|---|---|---|
| SMA | 4 | 4 | 4 |
| MEA | 5 | 5 | 5 |
| EtOH | 5 | 5 | 5 |
| PG | 5 | 5 | 5 |
| Water | 35 | 35 | 35 |
| Water-soluble graft polymer (2) | 5 | | |
| Water-soluble polymer (1) | | 5 | |
| Water-soluble polymer (3) | | | 5 |

TABLE 3

(Formulation Example 3: Anhydrous liquid detergent model composed mainly of anions)

| Formulation | G | H | I | J |
|---|---|---|---|---|
| MBAS | 12 | 12 | 14 | 14 |
| LAS | 32 | 32 | 32 | 32 |
| Sulfate | 2 | 2 | 2 | 2 |
| BPP | 20 | 20 | 20 | 20 |
| $C_{12-14}$ Alcohol $EO_5$ adduct | 5 | 5 | 5 | 5 |
| Carbonate | 5 | 5 | 5 | 5 |
| NOBS | 4 | 4 | 4 | 4 |
| PB1 | 15 | 15 | 13 | 15 |
| Water-soluble graft polymer (2) | 5 | | | |
| Water-soluble polymer (1) | | 5 | | |
| Water-soluble polymer (3) | | | 5 | |
| Water-soluble polymer (4) | | | | 3 |

Clay Dispersibility of Detergent Formulations:

Evaluation Methods (1) Clay Dispersibility of Detergent Formulations (Calcium Carbonate: 50 ppm):

Pure water is added to 67.56 g of glycine, 52.6 g of sodium chloride, and 2.4 g of NaOH to make 600 g (buffer (1)). To 60 g of the buffer (1), is added 0.0817 g of calcium chloride dihydrate, to which is then added pure water to make 1,000 g (buffer (2)). To 4 g of an aqueous solution of 1% by weight of the detergent formulation is 36 g of the buffer (2), and the mixture is stirred to prepare a dispersion. In a test tube (manufactured by Maruemu Corporation, diameter: 18 mm, height: 180 mm), is charged 0.3 g of a clay (JIS test powder I, class 11, available from The Association of Powder Process Industry and Engineering, Japan), to which is then added 30 g of the dispersion, followed by sealing the test tube. The test tube is shaken to uniformly disperse the clay. Thereafter, the test tube is allowed to stand in a place where the sun is not directly caught for 20 hours. After 20 hours, 5 cc of a supernatant of the dispersion is taken and measured for absorbance by a UV spectrometer (UV-1200 Model, manufactured by Shimadzu Corporation, 1 cm-cell, wavelength: 380 nm).

(2) Clay Dispersibility of Detergent Formulations (Calcium Carbonate: 200 ppm):

Pure water is added to 67.56 g of glycine, 52.6 g of sodium chloride, and 2.4 g of NaOH to make 600 g (buffer (1)). To 60 g of the buffer (1), is added 0.3268 g of calcium chloride dihydrate, to which is then added pure water to make 1,000 g (buffer (2)). To 4 g of an aqueous solution of 1% by weight of the detergent formulation is 36 g of the buffer (2), and the mixture is stirred to prepare a dispersion. In a test tube (manufactured by Maruemu Corporation, diameter: 18 mm, height: 180 mm), is charged 0.3 g of a clay (JIS test powder I, class 11, available from The Association of Powder Process Industry and Engineering, Japan), to which is then added 30 g of the dispersion, followed by sealing the test tube. The test tube is shaken to uniformly disperse the clay. Thereafter, the test tube is allowed to stand in a place where the sun is not directly caught for 20 hours. After 20 hours, 5 cc of a supernatant of the dispersion is taken and measured for absorbance by a UV spectrometer (UV-1200 Model, manufactured by Shimadzu Corporation, 1 cm-cell, wavelength: 380 nm).

Each of the following mid-chain branched surfactant compositions was incorporated with a polyalkylene glycol chain-containing polycarboxylic acid-based polymer to prepare a detergent formulation, whose dispersibility to clay was then measured.

The formulation amounts of the detergent formulation and the polymer are as follows.

TABLE 4

(Formulation Example 1': Powder detergent model composed mainly of anions)

| | B' | Comparative Formulation Example 1 |
|---|---|---|
| MLAS | 41 | 41 |
| SFT | 4 | 4 |
| SMA | 4 | 4 |
| Sodium carbonate | 44 | 44 |
| Water-soluble polymer (2) | 7 | |
| PSA | | 7 |
| Clay dispersibility | 0.43 | 0.40 |

TABLE 5

(Formulation Example 2': Liquid detergent model composed mainly of nonions)

| Formulation | D | E | F | Comparative Formulation Example 2 |
|---|---|---|---|---|
| MBAS | 4 | 4 | 4 | 4 |
| SFT | 32 | 32 | 32 | 32 |
| SMA | 4 | 4 | 4 | 4 |
| MEA | 5 | 5 | 5 | 5 |
| EtOH | 5 | 5 | 5 | 5 |
| PG | 5 | 5 | 5 | 5 |
| Water | 35 | 35 | 35 | 35 |
| Water-soluble graft polymer (2) | 5 | | | |
| Water-soluble polymer (1) | | 5 | | |
| Water-soluble polymer (3) | | | 5 | |
| Citrate | | | | 5 |
| Clay dispersibility | 0.58 | 1.05 | 1.00 | 0.05 |

With respect to the (meth)acrylic acid-based polymers according to the invention, the weight average molecular weight, anti-gelling capacity, and terminal sulfonic acid group were measured or quantitatively determined in the following manners.

(1) Measurement of weight average molecular weight and number average molecular weight:

The weight average molecular weight (hereinafter abbreviated as "Mw") of the (meth)acrylic acid-based polymer was measured by GPC (gel permeation chromatography). At this time, Model GF-7MHQ (a trade name, manufactured by Showa Denko K.K.) was used as a column of GPC. As a mobile phase, was used an aqueous solution prepared by adding ion-exchanged water (hereinafter referred to as "pure water") to 34.5 g of disodium hydrogenphosphate dodecahydrate and 46.2 g of sodium dihydrogenphosphate dihydrate to make 5,000 g in total and filtering the mixture through a 0.45-μm membrane filter. Incidentally, any of the reagents as used herein are of a special grade. Further, all of the reagents as used in the measurement of degree of gelation and Examples as described blow are of a special grade. As a detector, was used Model 481, manufactured by Waters Corporation (detection wavelength UV: 214 nm). As a pump, was used Model L-7110 (manufactured by Hitachi, Ltd.). The flow rate of the mobile phase was defined as 0.5 ml/min., and the temperature was set up at 35° C. A calibration curve was prepared by using a standard sample of sodium polyacrylate manufactured by Sowa Kagaku K.K.

(2) Measurement of degree of gelation:

In the measurement of the degree of gelation, a boric acid buffer solution, a calcium chloride aqueous solution, and a 1% polymer aqueous solution were first prepared. The boric acid buffer solution is one prepared by adding pure water to 7.42 g of boric acid, 1.75 g of sodium chloride and 7.63 g of sodium borate decahydrate to make 1,000 g in total. The calcium chloride aqueous solution is one prepared by adding pure water to 0.735 g of calcium chloride dihydrate to make 2,500 g in total. The 1% polymer aqueous solution is one prepared by diluting the polymer according to the invention with pure water to make 1% in concentration.

Next, prescribed amounts of the foregoing solutions were charged in a 500-mL tall beaker in a prescribed order. The prescribed amounts and the prescribed order are as follows. First, 250 ml of pure water was charged; secondly, 10 ml of the boric acid buffer solution was charged; thirdly, 5 ml of the 1% by weight polymer aqueous solution was charged; and finally, 250 ml of the calcium chloride aqueous solution was charged.

The respective solutions thus charged in this order were mixed to make the polymer according to the invention gel, thereby preparing a test solution. The tall beaker having the test solution charged therein was lidded and allowed to stand for one hour in a thermostatic chamber previously regulated at 90° C. After one hour, the test solution was immediately charged in a 5-cm quartz cell and measured for an absorbance a at a UV wavelength of 380 nm.

Separately, among the above four ingredients charged as the test solution, 250 ml of the calcium chloride aqueous solution was replaced by 250 ml of pure water to prepare a blank solution. This black solution was subjected to the same procedures as in the test solution to measure an absorbance b (blank value) at a UV wavelength of 380 nm. The degree of gelation was calculated from the absorbance a and the blank value b according to the following equation.

$$(\text{Degree of gelation})=a-b$$

Using this degree of gelation, an anti-gelling capacity (Q value) was calculated according to the following equation.

$$Q=(\text{Degree of gelation})\times 10^5/Mw$$

(3) Measurement of S amount contained in the polymer and pre-S amount:

The S amount of the (meth)acrylic acid-based polymer before and after the treatment was quantitatively determined by inductively coupled plasma (ICP) emission spectrometry. Here, the S amount of the (meth)acrylic acid-based polymer before dialysis was defined as "pre-S amount), and the S amount of the (meth)acrylic acid-based polymer after the dialysis was defined as "S amount contained in the polymer", respectively. The dialysis will be described below.

Dialysis (1) A suitable amount of water was added to the (meth) acrylic acid-based polymer (or its aqueous solution) to prepare a (meth)acrylic acid-based polymer aqueous solution having a solids content of 30% by weight, and 20 g of the (meth)acrylic acid-based polymer aqueous solution was then charged in a dialysis membrane having a length of 40 cm, followed by sealing. As the dialysis membrane, was used Spectra/Por Membrane MWCO: 1000, molecular weight cut off: 1,000 (manufactured by Spectrum Laboratories, Inc.). (Incidentally, any dialysis membranes having a molecular weight cut off equal to this dialysis membrane may be employed in the invention.)

(2) The resulting dialysis membrane was dipped in 2,000 g of water charged in a 2-L beaker and stirred with a stirrer.

(3) Six hours later, the dialysis membrane was taken out from the beaker, the outside of the dialysis membrane was well rinsed with water, and the contents of the dialysis membrane were then taken out.

(4) The resulting contents were concentrated by an evaporator to prepare a (meth)acrylic acid-based polymer sample after the dialysis treatment.

As the (meth)acrylic acid-based polymer sample before the dialysis treatment, was used one prepared by concentrating the (meth)acrylic acid-based polymer obtained by the polymerization as in (1) above by the evaporator in the same manner as in (4) above.

(4) Quantitative determination of terminal sulfonic acid group and measurement of R value:

| | |
|---|---|
| Kind: | Varian Gemini2000 (200 MHz) |
| Resonance frequency: | 199.93 MHz |
| Probe: | 5 mm Switchable probe |
| Observation nucleus: | Hydrogen nucleus |

Measurement Conditions:

| | |
|---|---|
| 90 Degree pulse: | 100 μsec. (irradiation with 45 degree pulse) |
| Waiting time: | 1.254 sec. |
| Number of integration: | 16 times |
| Temperature: | Room temperature |

Sample Preparation:

$D_2O$ was added to 0.1 g of the (meth)acrylic acid-based polymer from which the solvent had been removed upon drying in vacuo to make 1.0 g and completely dissolved to prepare a sample.

The quantitative determination of the terminal sulfonic acid group was performed by first measuring the (meth) acrylic acid-based polymer obtained in an aqueous solution state by $^1$H-NMR ($D_2O$ solvent). As a result, a peak of methylene hydrogen derived from the sulfonic acid group was detected in the vicinity of 2.4 ppm, and a peak of methylene hydrogen derived from the sulfonic acid group was detected in the vicinity of 3.0 ppm, respectively, the both peaks being not observed in the case of the polymerization using the persulfate (NaPS) alone.

Then, an integration ratio of these peaks to peaks of methylene hydrogen in the backbone of sodium polyacrylate and methylene hydrogen (in the vicinity of from about 1 to 2.2 ppm) was calculated, thereby undergoing the quantitative determination of the terminal sulfonic acid group of the (meth)acrylic acid-based polymer.

(5) Measurement of iron ion concentration:

The iron ion concentration of the (meth)acrylic acid-based polymer was quantitatively determined according to ICP emission spectrometry.

SYNTHESIS EXAMPLE 7

Sulfonic Acid Group-terminated (Meth)acrylic Acid-based Polymer Having an Anti-gelling Capacity of Less Than 2.0:

In a 5-liters volume SUS-made separable flask equipped with a reflux condenser and a stirrer, 300 g of pure water was charged (initial charging) and elevated to the boiling point while stirring. Subsequently, 720 g (i.e., 8 mole) of an 80% acrylic acid aqueous solution (hereinafter abbreviated as "80% AA"), 106.7 g (2 g/mole, as reduced into the amount of the monomer as charged) of a 15% sodium persulfate aqueous solution (hereinafter abbreviated as "15% NaPS"), 182.9 g (8 g/mole, as reduced into the amount of the monomer as charged) of a 35% sodium bisulfite aqueous solution (hereinafter abbreviated as "35% SBS"), and 126.5 g of pure water were added dropwise from separate dropping nozzles to the polymerization reaction system in the boiling point-reflux state with stirring over 120 minutes.

After completion of the dropwise addition, the reaction solution was further kept (aged) in the boiling point-reflux state over 30 minutes to complete the polymerization. After completion of the polymerization, the reaction solution was allowed to cool and then neutralized by gradually adding dropwise 600 g (i.e., 7.2 moles) of a 48% sodium hydroxide aqueous solution (hereinafter abbreviated as "48% NaOH") thereto while stirring. There was thus obtained an aqueous solution of sodium polyacrylate (1) (hereafter referred to as "polymer (1)") having a solids content of 40% and a final degree of neutralization of 90%.

The resulting polymer (1) had a weight average molecular weight (Mw) of 8,700, an anti-gelling capacity (Q value) of 1.09, and an amount (measured value) of terminal sulfonic acid group of SBS/AA=1/13.8 (mole) [charging ratio: 1/13 (by mole)].

SYNTHESIS EXAMPLE 8

(Meth)acrylic Acid-based Polymer Having a Sulfur Introduction Amount (S Value) of 35 or More:

(Meth)acrylic Acid-based Polymer Having an R Value of From 1 to 15:

In a 2.5-liters volume SUS-made separable flask equipped with a reflux condenser and a stirrer, 156.5 g of pure water was charged (initial charging) and elevated to 90° C. while stirring. Subsequently, 427.5 g (i.e., 4.75 mole) of 80% AA, 63.5 g (i.e., 0.25 moles) of a 37% sodium acrylate aqueous solution (hereafter abbreviated as "37% SA"), 66.7 g (2.0 g/mole, as reduced into the amount of the monomer as charged) of 15% NaPS, and 71.4 g (5.0 g/mole, as reduced into the amount of the monomer as charged) of 35% SBS were added dropwise from separate dropping nozzles to the polymerization reaction system in a constant state at about 90° C. with stirring. The dropwise addition time was 300 minutes for 80% AA, 37% SA and 35% SBS and 310 minutes for 15% NaPS, respectively.

After completion of the dropwise addition, the reaction solution was further kept at 90° C. over 30 minutes to complete the polymerization. After completion of the polymerization, the reaction solution was allowed to cool and then neutralized by gradually adding dropwise 366.7 g (i.e., 4.40 moles) of 48% NaOH thereto while stirring. There was thus obtained an aqueous solution of sodium polyacrylate (2) (hereafter referred to as "polymer (2)") having a solids content of 45% and a final degree of neutralization of 93%.

The resulting polymer (2) had a weight average molecular weight of 5,800, a number average molecular weight of 2,400, an S value of 49, an R value of 5.0, a Q value of 2.02, and an iron ion concentration of 1.40 ppm.

Performance Evaluation:

Detergent formulations and formation amounts of polymer are as follows.

TABLE 6

(Formulation Example 4: Powder detergent model composed mainly of anions)

| Formulation | A | B |
|---|---|---|
| MLAS | 29 | 29 |
| SFT | 3 | 3 |
| SMA | 3 | 3 |
| Zeolite A | 30 | 30 |
| PEG | 1 | 1 |
| Carbonate | 29 | 29 |
| Polymer (1) | 5 | |
| Polymer (2) | | 5 |

TABLE 7

(Formulation Example 5: Powder detergent model composed mainly of nonions)

| Formulation | C | D |
|---|---|---|
| MBAS | 4 | 4 |
| SFT | 31 | 31 |
| SMA | 4 | 4 |
| Zeolite A | 30 | 30 |
| PEG | 1 | 1 |
| Carbonate | 25 | 25 |
| Polymer (1) | 5 | |
| Polymer (2) | | 5 |

Clay Dispersibility of Detergent Formulations:

The dispersion ability of each detergent formulation comprising the polymer having the following mid-chain branched surfactant composition incorporated therein to clay was measured in the same manner as described above.

Detergent formulations and formation amounts of polymer are as follows.

TABLE 8

(Formulation Example 4': Powder detergent model composed mainly of anions)

| Formulation | A' | B' | Comparative Formulation Example 1 |
|---|---|---|---|
| MLAS | 41 | 41 | 41 |
| SFT | 4 | 4 | 4 |
| SMA | 4. | 4 | 4 |
| Sodium carbonate | 44 | 44 | 44 |
| Polymer (1) | 7 | | |
| Polymer (2) | | 7 | |
| PSA | | | 7 |
| Clay dispersibility (calcium carbonate: 50 ppm) | 0.43 | 0.44 | 0.40 |

TABLE 9

(Formulation Example 5': Powder detergent model composed mainly of nonions)

| Formulation | C | D | Comparative Formulation Example 2 |
|---|---|---|---|
| MBAS | 4 | 4 | 4 |
| SET | 41 | 41 | 41 |
| SMA | 4 | 4 | 4 |
| Carbonate | 44 | 44 | 44 |
| Polymer (1) | 7 | | |
| Polymer (2) | | 7 | |
| PSA | | | 7 |
| Clay dispersibility (calcium carbonate: 200 ppm) | 0.59 | 0.60 | 0.55 |

With respect to the acrylic acid (salt)-maleic acid (salt)-based polymers according to the invention, the weight average molecular weight, clay dispersibility, and calcium ion-binding capacity were measured or quantitatively determined in the following manners.

(1) Measurement of Weight Average molecular weight and number average molecular weight:

The weight average molecular weight (hereinafter abbreviated as "Mw") of the acrylic acid (salt)-maleic acid (salt)-based polymer was measured by GPC (gel permeation chromatography). At this time, Model GF-7MHQ (a trade name, manufactured by Showa Denko K.K.) was used as a column of GPC. As a mobile phase, was used an aqueous solution prepared by adding ion-exchanged water (hereinafter referred to as "pure water") to 34.5 g of disodium hydrogenphosphate dodecahydrate and 46.2 g of sodium dihydrogenphosphate dihydrate to make 5,000 g in total and filtering the mixture through a 0.45-μm membrane filter. Incidentally, any of the reagents as used herein are of a special grade. Further, all of the reagents as used in the measurement of degree of gelation and Examples as described blow are of a special grade. As a detector, was used Model 481, manufactured by Waters Corporation (detection wavelength UV: 214 nm). As a pump, was used Model L-7110 (manufactured by Hitachi, Ltd.). The flow rate of the mobile phase was defined as 0.5 ml/min., and the temperature was set up at 35° C. A calibration curve was prepared by using a standard sample of sodium polyacrylate manufactured by Sowa Kagaku K.K.

(2) Clay-dispersibility:

Clay-dispersibility in High-hardness Water (Calcium Concentration: 200 ppm)

First, ion-exchanged water was added to 67.56 g of glycine, 52.6 g of sodium chloride, and 60 ml of 1N-NaOH to make 600 g, thereby preparing a glycine buffer solution. To 60 g of the preparation liquid, was added 0.3268 g of calcium chloride dihydrate, to which was then added ion-exchanged water to make 1,000 g, thereby preparing a dispersion.

Next, an aqueous solution of the polymer (adjusted at a pH of 7) of 0.1% as reduced into solids content was prepared. In a test tube, was charged 0.3 g of 8 kinds of a clay (JIS test powder I, class 11 (Kanto loam, fine granules, available from The Association of Powder Process Industry and Engineering, Japan), to which was then added 3 g of the foregoing preparation liquid. As this time, the calcium concentration of this test solution is 200 ppm as reduced into calcium carbonate.

The test tube was sealed by a paraffin film and lightly shaken such that the clay was uniformly dispersed, and further shaken 20 times in the vertical direction. The resulting test tube was allowed to stand in a place where the sun was not directly caught for 20 hours. Thereafter, 5 ml of a supernatant of the dispersion was collected by means of a transfer pipette. This solution was measured for transmittance (T %) in a 1-cm cell at a wavelength of 380 nm by means of a spectrometer. A value obtained by subtracting this T % from 100 was defined as a clay-dispersibility (cloudiness).

Clay-dispersibility in Low-hardness Water (Calcium Concentration: 50 ppm)

The clay-dispersibility in low-hardness water was determined in the same manner as in the foregoing measurement of the clay-dispersibility in high-hardness water, except that the addition amount of the calcium chloride dihydrate was changed to 0.0817 g (50 ppm as reduced into calcium carbonate).

(3) Calcium Ion-Binding Capacity:

Calcium Ion-binding Capacity

First, a calcium ion standard aqueous solution (aqueous solution for calibration curve) was prepared in the following manner. That is, using calcium chloride dihydrate, 50 cc of each of aqueous solutions having a $Ca^{2+}$ ion concentration of 0.01 moles/liter, 0.001 moles/liter and 0.0001 moles/liter was prepared, and the pH of each aqueous solution was adjusted at from 9 to 11 with a 4.8% sodium hydrochloride aqueous solution, to which was then added 1 ml of an aqueous solution of 4 moles/liter of potassium chloride.

Next, a sample aqueous solution for measurement was prepared. That is, the polymer (adjusted at a pH of 7) in an amount of 10 mg as reduced into solids content was weighed in a 100-ml beaker, to which was then added 50 ml of the aqueous solution having a calcium ion concentration of 0.001 moles/liter as adjusted with sodium chloride dihydrate. The mixture was uniformly stirred by means of a stirrer, the pH of the mixture was adjusted at from 9 to 11 with a 4.8% sodium hydroxide aqueous solution, and 1 ml of an aqueous solution of 4 moles/liter of potassium chloride was then added thereto.

The measurement was carried out with calcium ion electrodes 93-20 (manufactured by Orion Corporation) by using an ion analyzer EA920 (manufactured by Orion Corporation). The calcium ion amount captured by the sample was determined from the calibration curve and the measured value of the sample (polymer), and the binding amount per gram of the solids content of the polymer was expressed in terms of milligram number as reduced into calcium carbonate. This value was defined as a calcium ion-binding value.

SYNTHESIS EXAMPLE 9

Acrylic Acid/Maleic Acid Composition Ratio=80/20 by Mole:

In a 2.5-liters volume SUS-made separable flask equipped with a thermometer, a stirrer and a reflux condenser, was charged 282.8 g of ion-exchanged water (hereinafter referred to as "pure water"), and the aqueous solution was elevated to the boiling point in the reflux state while stirring. Next, 360.0 g of an 80% by weight acrylic acid aqueous solution (hereinafter referred to as "80% AA"), 98.0 g of maleic anhydride (hereinafter referred to as "MA"), 133.3 g of a 15% by weight sodium persulfate aqueous solution (hereinafter referred to as "15% NaPS"), 85.7 g of a 35% by weight hydrogen peroxide aqueous solution (hereinafter referred to as "35% $H_2O_2$), and 350.0 g of a 48% by weight sodium hydroxide aqueous solution (hereinafter referred to as "48% NaOH") were continuously added dropwise at uniform rates from separate dropping nozzles over 180 minutes from the initiation of the polymerization, 150 minutes from the initiation of the polymerization, 190 minutes from the initiation of the polymerization, 120 minutes from the initiation of the polymerization, and 180 minutes from the initiation of the polymerization, respectively, while keeping the reflux state with stirring. After the completion of the dropwise addition of all of the aqueous solutions, the boiling point reflux state was kept over 20 minutes. Finally, 100.0 g of 48% NaOH was added to the reaction mixture to complete the polymerization.

There was thus obtained an acrylic acid/maleic acid copolymer 1 having a solids content of 40.3% (hereinafter referred to as "polymer 1"). The resulting polymer 1 had a weight average molecular weight (Mw) of 5,800.

SYNTHESIS EXAMPLE 10

Acrylic Acid/Maleic Acid Composition Ratio=50/50 by Mole:

In a 2.5-liters volume SUS-made separable flask equipped with a thermometer, a stirrer and a reflux condenser, was charged 196.5 g of pure water, and the aqueous solution was elevated to the boiling point in the reflux state while stirring. Next, 180.0 g of 80% AA, 196.0 g of MA, 106.7 g of 15% NaPS, 68.6 g of 35% $H_2O_2$, 300.0 g of 48% NaOH, and 136.9 g of pure water were continuously added dropwise at uniform rates from separate dropping nozzles over 180 minutes from the initiation of the polymerization, 70 minutes from the initiation of the polymerization, 190 minutes from the initiation of the polymerization, 150 minutes from the initiation of the polymerization, 180 minutes from the initiation of the polymerization, and 180 minutes from the initiation of the polymerization, respectively, while keeping the reflux state with stirring. After the completion of the dropwise addition of all of the aqueous solutions, the boiling point reflux state was kept over 20 minutes. Finally, 125.0 g of 48% NaOH was added to the reaction mixture to complete the polymerization.

There was thus obtained an acrylic acid/maleic acid copolymer 2 having a solids content of 39.4% (hereinafter referred to as "polymer 2"). The resulting polymer 2 had a weight average molecular weight (Mw) of 3,200.

SYNTHESIS EXAMPLE 11

Acrylic Acid/Maleic Acid Composition Ratio=70/30 by Mole:

In a 2.5-liters volume SUS-made separable flask equipped with a thermometer, a stirrer and a reflux condenser, was charged 260.0 g of pure water, and the aqueous solution was elevated to the boiling point in the reflux state while stirring. Next, 252.0 g of 80% AA, 117.6 g of MA, 106.7 g of 15% NaPS, 68.6 g of 35% $H_2O_2$, and 216.7 g of 48% NaOH were continuously added dropwise at uniform rates from separate dropping nozzles over 240 minutes from the initiation of the polymerization, 180 minutes from the initiation of the polymerization, 250 minutes from the initiation of the polymerization, 120 minutes from the initiation of the polymerization, and 240 minutes from the initiation of the polymerization, respectively, while keeping the reflux state with stirring. After the completion of the dropwise addition of all of the aqueous solutions, the boiling point reflux state was kept over 50 minutes. Finally, 164.7 g of 48% NaOH was added to the reaction mixture to complete the polymerization.

There was thus obtained an acrylic acid/maleic acid copolymer 3 having a solids content of 39.9% (hereinafter referred to as "polymer 3"). The resulting polymer 3 had a weight average molecular weight (Mw) of 6,300.

SYNTHESIS EXAMPLE 12

Acrylic Acid/Maleic Acid Composition Ratio=60/40 by Mole:

In a 2.5-liters volume SUS-made separable flask equipped with a thermometer, a stirrer and a reflux condenser, was initially charged 295.0 g of pure water, and the aqueous solution was elevated to the boiling point in the reflux state while stirring. Next, 216.0 g of 80% AA, 156.8 g of MA, 106.7 g of 15% NaPS, 68.6 g of 35% $H_2O_2$, and 256.7 g of 48% NaOH were continuously added dropwise at uniform rates from separate dropping nozzles over 180 minutes from the initiation of the polymerization, 100 minutes from the initiation of the polymerization, 190 minutes from the initiation of the polymerization, 120 minutes from the initiation of the polymerization, and 240 minutes from the initiation of the polymerization, respectively, while keeping the reflux state with stirring. After the completion of the dropwise addition of all of the aqueous solutions, the boiling point reflux state was kept over 50 minutes. Finally, 140.0 g of 48% NaOH was added to the reaction mixture to complete the polymerization.

There was thus obtained an acrylic acid/maleic acid copolymer 4 having a solids content of 39.4% (hereinafter referred to as "polymer 4"). The resulting polymer 4 had a weight average molecular weight (Mw) of 4,900.

SYNTHESIS EXAMPLE 13

Acrylic Acid/Maleic Acid Composition Ratio=52/48 by Mole:

In a 5-liters volume SUS-made separable flask equipped with a thermometer, a stirrer and a reflux condenser, were charged 310.0 g of pure water and 450 g of maleic anhydride, to which was then gradually added 708.3 g of 48% by weight NaOH while stirring. Thus, the initial degree of neutralization was 85% by mole, and the initial solids content was 50.9% by weight. Thereafter, the aqueous solution was elevated to the boiling point in the reflux state while stirring. Next, 450.0 g of 80% AA, 100 g of 35% $H_2O_2$, 200.0 g of 15% NaPS, and 30 g of pure water were continuously added dropwise at uniform rates from separate dropping nozzles over 120 minutes from the initiation of the polymerization, 50 minutes from the initiation of the polymerization, 130 minutes from 50 minutes after the initiation of the polymerization, and 130 minutes from 50 minutes after the initiation of the polymerization, respectively, while keeping the reflux state with stirring. After the completion of the dropwise addition of all of the aqueous solutions, the boiling point reflux state was kept over 20 minutes. Finally, the pH of the acrylic acid/maleic acid copolymer aqueous solution was adjusted at 8 with 48% NaOH.

There was thus obtained an acrylic acid/maleic acid copolymer 5 (hereinafter referred to as "polymer 5"). The resulting polymer 5 had a weight average molecular weight (Mw) of 10,000 and a number average molecular weight of 2,900. That is, the molecular weight distribution was 3.45.

SYNTHESIS EXAMPLE 14

Acrylic Acid/Maleic Acid Composition Ratio=71/29 by Mole:

In a 5-liters volume SUS 316-made separable flask equipped with a thermometer, a stirrer and a reflux condenser, were charged 281.3 g of pure water and 176.4 g of maleic anhydride, to which was then gradually added 300 g of 48% by weight NaOH while stirring. Thus, the initial degree of neutralization was 100% by mole, and the initial solids content was 38.1% by weight. Thereafter, the aqueous solution was elevated to the boiling point in the reflux state while stirring. Next, 401.7 g of 80% AA, 89.3 g of 35% $H_2O_2$, 124.6 g of 15% NaPS, and 177.5 g of pure water were continuously added dropwise at uniform rates from separate dropping nozzles over 240 minutes from the initiation of the polymerization, 240 minutes from the initiation of the polymerization, 245 minutes from the initiation of the polymerization, and 246 minutes from 90 minutes after the initiation of the polymerization, respectively, while keeping the reflux state with stirring. After the completion of the dropwise addition of all of the aqueous solutions, the boiling point reflux state was kept over 30 minutes. Thereafter, 263 g of 48% by weight NaOH was added to the reaction mixture, to which were then added 27.9 g of 35% by weight sodium hydrogensulfite, 50.9 g of 48% by weight NaOH, and 128.6 g of water, to prepare an acrylic acid/maleic acid copolymer aqueous solution.

There was thus obtained an acrylic acid/maleic acid copolymer 6 (hereinafter referred to as "polymer 6"). The resulting polymer 6 had a weight average molecular weight (Mw) of 11,000 and a number average molecular weight of 2,800. That is, the molecular weight distribution was 3.93.

TABLE 10

| | 1 | 2 | 3 | 4 | 5 | 6 |
|---|---|---|---|---|---|---|
| AA/MA (mole/mole) | 80/20 | 50/50 | 70/30 | 60/40 | 52/48 | 71/29 |
| Mw | 5,800 | 3,200 | 6,300 | 4,800 | 10,000 | 11,000 |
| Clay-dispersibility (calcium carbonate: 50 ppm) | 0.77 | 0.71 | 0.77 | 0.67 | 0.69 | 0.75 |
| Clay-dispersibility (calcium carbonate: 200 ppm) | 0.47 | 0.09 | 0.51 | 0.10 | 0.07 | 0.50 |
| Calcium ion-binding capacity (mg/g) | 283 | 355 | 315 | 336 | 422 | 348 |

Performance Evaluation:

Detergent formulations and formation amounts of polymer are as follows.

TABLE 11

(Formulation Example 6: Powder detergent model composed mainly of anions)

| Formulation | A | E | C | D | B | H |
|---|---|---|---|---|---|---|
| MLAS | 29 | 29 | 29 | 29 | 29 | 29 |
| SFT | 3 | 3 | 3 | 3 | 3 | 3 |
| SMA | 3 | 3 | 3 | 3 | 3 | 3 |
| Zeolite A | 30 | 30 | 30 | 30 | 30 | 30 |
| PEG | 1 | 1 | 1 | 1 | | 1 |
| Carbonate | 29 | 29 | 29 | 29 | 29 | 29 |
| Polymer 1 | 5 | | | | | |

TABLE 11-continued (Formulation Example 6: Powder detergent model composed mainly of anions)

| Formulation | A | E | C | D | B | H |
|---|---|---|---|---|---|---|
| Polymer 2 | | 5 | | | | |
| Polymer 3 | | | 5 | | | |
| Polymer 4 | | | | 5 | | |
| Polymer 5 | | | | | 5 | |
| Polymer 6 | | | | | | 5 |

TABLE 12

(Formulation Example 7: Powder detergent model composed mainly of nonions)

| Formulation | F | G |
|---|---|---|
| MBAS | 4 | 4 |
| SFT | 31 | 31 |
| SMA | 4 | 4 |
| Zeolite A | 30 | 30 |
| PEG | 1 | 1 |
| Carbonate | 25 | 25 |
| Polymer 1 | 5 | |
| Polymer 3 | | 5 |

Clay Dispersibility of Detergent Formulations:

The dispersion force of each detergent formulation comprising the polymer having the following mid-chain branched surfactant composition incorporated therein to clay was measured in the same manner as described above.

Detergent formulations and formation amounts of polymer are as follows.

TABLE 13

(Formulation Example 6': Powder detergent model composed mainly of anions)

| Formulation | A' | B' | H' | Comparative Formulation Example 1 |
|---|---|---|---|---|
| MLAS | 41 | 41 | 41 | 41 |
| SFT | 4 | 4 | 4 | 4 |
| SMA | 4 | 4 | 4 | 4 |
| Sodium carbonate | 44 | 44 | 45 | 44 |
| Polymer 1 | 7 | | | |
| Polymer 5 | | 7 | | |
| Polymer 6 | | | 6 | |

TABLE 13-continued (Formulation Example 6': Powder detergent model composed mainly of anions)

| Formulation | A' | B' | H' | Comparative Formulation Example 1 |
|---|---|---|---|---|
| AA/MA | | | | 7 |
| Clay dispersibility (calcium carbonate: 50 ppm) | 0.54 | 0.50 | 0.56 | 0.41 |

TABLE 14

(Formulation Example 7': Powder detergent model composed mainly of nonions)

| Formulation | F' | G' | Comparative Formulation Example 2 |
|---|---|---|---|
| MBAS | 4 | 4 | 4 |
| SFT | 44 | 44 | 44 |
| SMA | 4 | 4 | 4 |
| Carbonate | 44 | 44 | 44 |
| Polymer 1 | 7 | | |
| Polymer 3 | | 7 | |
| AA/MA | | | 7 |
| Clay dispersibility (calcium carbonate: 200 ppm) | 0.46 | 0.43 | 0.35 |

The invention relates to detergent compositions comprising a specific polymer and an alkyl mid-chain branched surfactant. These detergent compositions have high detergency against stains such as mud and carbon black, enhance anti-gelling properties to calcium ions, etc., and enhance detergency at low temperatures or under high-hardness conditions.

It should further be apparent to those skilled in the art that various changes in form and detail of the invention as shown and described above may be made. It is intended that such changes be included within the spirit and scope of the claims appended hereto.

This application is based on Japanese Patent Application Nos. 2002-114307 filed Apr. 17, 2002, 2002-116172 filed Apr. 18, 2002, 2002-116181 filed Apr. 18, 2002 and 2002-228216 filed Aug. 6, 2002, the disclosures of which are incorporated herein by reference in their entireties.

What is claimed is:

1. A detergent composition comprising:

at least 0.1% by weight of at least one polymer selected from the group consisting of 1) a polycarboxylic acid-based polymer containing a polyalkylene glycol chain in the structure thereof and 2) a sulfonic acid group-terminated (meth)acrylic acid-based polymer, and at least 0.5% by weight of a longer alkyl chain mid-chain branched surfactant compound represented by the following formula:

R—X—Y wherein:

(a) R is a hydrophobic C9 to C22, as total carbons in the moiety, mid-chain branched alkyl moiety having: (1) a longest linear carbon chain attached to the —X—Y moiety in the range of from 8 to 21 carbon atoms; (2) one or more $C_1$–$C_3$ alkyl moieties branching from this longest linear carbon chain; (3) at least one of the branching alkyl moieties is attached directly to a carbon of the longest linear carbon chain at a position within the range of position 2 carbon (counting from carbon 1 which is attached to the —X—Y moiety) to position ω−2 carbon (the terminal carbon minus 2 carbons); and (4) the surfactant composition has an average total number of carbon atoms in the R—X moiety in the above formula within the range of greater than 14 to 18;

(b) Y is a hydrophilic moiety selected from sulfates, sulfonates, amine oxides, and polyoxyalkylenes; and (c) X is selected from —$CH_2$— and —C(O)—.

2. The detergent composition as claimed in claim 1, wherein the polycarboxylic acid-based polymer is a water-soluble graft polymer comprising a polyalkylene glycol having a monoethylenically unsaturated carboxylic acid-based monomer graft polymerized thereon.

3. The detergent composition as claimed in claim 1, wherein the polycarboxylic acid-based polymer is a water-soluble graft polymer comprising a polyalkylene glycol-containing ethylenically unsaturated monomer (not containing an ester bond between the polyalkylene glycol chain and the ethylenically unsaturated bond) having a monoethylenically unsaturated carboxylic acid-based monomer copolymerized therewith.

4. The detergent composition as claimed in claim 1, wherein the polycarboxylic acid-based polymer is a water-soluble graft polymer comprising a polyalkylene glycol-containing ethylenically unsaturated monomer (containing an ester bond between the polyalkylene glycol chain and the ethylenically unsaturated bond) having a monoethylenically unsaturated carboxylic acid-based monomer copolymerized therewith.

5. The detergent composition as claimed in claim 1, wherein the (meth)acrylic acid-based polymer is a polymer comprising from 50 to 100 mole % of (meth)acrylic acid and from 0 to 50 mole % of a water-soluble monoethylenically unsaturated monomer that is copolymerizable with (meth) acrylic acid, having a sulfonic acid group at the terminals thereof and having an anti-gelling capacity Q, as defined by the following equation, of less than 2.0:

$$Q=[(\text{Degree of gelation})\times 10^5]/(\text{Weight average molecular weight}).$$

6. The detergent composition as claimed in claim 1, wherein the (meth)acrylic acid-based polymer has an introduction amount of sulfur element, S value, as defined by the following equation, of 35 or more:

$$S=(S\text{ amount contained in the polymer})/(\text{Total } S \text{ amount})\times 100.$$

7. The detergent composition as claimed in claim 1, wherein the (meth)acrylic acid-based polymer has an R value, as defined by the following equation, of from 1 to 15 in the $^1$H-NMR spectrum:

$$R=(\text{Integration ratio of signal at 2.3 to 4.3 ppm})/(\text{Integration ratio at 0.8 to 4.3 ppm containing PSA signal})\times 100.$$

8. The detergent composition as claimed in claim 1, wherein the detergent composition is a liquid detergent composition and/or a gel detergent composition.

9. The detergent composition as claimed in claim 1, wherein the detergent composition is a powder detergent composition.

* * * * *